US006468726B2

(12) United States Patent
Haraoka et al.

(10) Patent No.: US 6,468,726 B2
(45) Date of Patent: Oct. 22, 2002

(54) PHOTOTHERMOGRAPHIC IMAGE-RECORDING MATERIAL WITH POLYESTER SUB

(75) Inventors: Hiroshi Haraoka, Shizuoka (JP); Sadao Fujikura, Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/906,837

(22) Filed: Jul. 18, 2001

(65) Prior Publication Data

US 2002/0042031 A1 Apr. 11, 2002

(30) Foreign Application Priority Data

Jul. 21, 2000 (JP) ..... 2000-219943

(51) Int. Cl.[7] ..... G03C 1/498; G03C 1/795
(52) U.S. Cl. ..... 430/533; 430/619
(58) Field of Search ..... 430/533, 534, 430/535, 619

(56) References Cited

U.S. PATENT DOCUMENTS 5,288,601 A * 2/1994 Greener et al. ..... 430/533
6,110,659 A * 8/2000 Hatakeyama et al. ..... 430/533

FOREIGN PATENT DOCUMENTS

EP 629620 * 6/1981

* cited by examiner

*Primary Examiner*—Richard L. Schilling
(74) *Attorney, Agent, or Firm*—Sughrue Mion, PLLC

(57) ABSTRACT

A photothermographic image-recording material having a good adhesion between a subbing layer and a support or an image-forming layer is described, which comprises a support, at least one subbing layer comprising a polyester provided on at least one side of the support and an image-forming layer provided on the subbing layer, wherein the polyester is a polyester having a glass transition temperature of from 40° C. to 100° C. comprising an acid component and an alcohol component, the acid component comprises at least one of terephthalic acid and isophthalic acid in a total amount of from 40 to 90 mol % and isophthalic acid having a sulfonyloxy group represented by the following formula (1) in an amount of from 10 to 60 mol %, and the alcohol component comprises diethylene glycol in an amount of from 40 to 90 mol % and cyclohexane dimethanol in an amount of from 10 to 60 mol %:

$$-(SO_3)_nM \quad (1)$$

wherein M represents a hydrogen atom, alkaline or alkaline earth metal or quaternary ammonium residue, and n represents the same number as a valence number of M.

2 Claims, No Drawings

PHOTOTHERMOGRAPHIC IMAGE-RECORDING MATERIAL WITH POLYESTER SUB

FIELD OF THE INVENTION

The present invention relates to a photothermographic image-recording material and more particularly to a photothermographic material.

BACKGROUND OF THE INVENTION

In recent years, it has been keenly desired in the art of film for medical diagnosis or photomechanical process film to reduce the amount of waste liquid to be disposed from the standpoint of environmental protection and reduction of space. Thus, a technique has been required concerning a photothermographic material as film for medical diagnosis or photomechanical process film which can be efficiently exposed to light by a laser image setter or laser imager to form a clear black image having a high resolution and sharpness. Such a photothermographic material requires no solution type processing chemicals and thus can provide customers with a simpler heat development system which is harmless to environment.

The art of general image-forming material, too, has the same requirements. In particular, an image for medical diagnosis is required to give a fine drawing and hence a high quality having excellent sharpness and graininess. Further, a blue black image is desired from the standpoint of ease of diagnosis. At present, various hard copy systems using pigment and dye such as ink jet printer and electrophotography are circulated as general imaging system. However, none of these systems are satisfactory as medical image outputting system.

On the other hand, heat imaging systems using an organic silver salt are disclosed in U.S. Pat. Nos. 3,152,904 and 3,457,075, D. Klosterboer, "Thermally Processed Silver Systems", Imaging Processes and Materials, Neblette, 8th ed., compiled by J. Sturge, V. Walworth, A. Shepp, Chapter 9, page 279, 1989. In particular, a photothermographic material normally comprises a photosensitive layer having a catalytically active amount of a photocatalyst (e.g., silver halide), a reducing agent, a reducible silver salt (e.g., organic silver salt), and optionally a color toner for controlling the tone of silver dispersed in a binder matrix. A photothermographic material which has been imagewise exposed to light is heated to a high temperature (e.g., not lower than 80° C.) to undergo redox reaction of the reducible silver salt (which acts as an oxidizing agent) with the reducing agent, forming a black silver image. The redox reaction is accelerated by the catalytic action of latent image of silver halide produced by exposure. Thus, the black silver image is formed in the exposed area. This photothermographic material is disclosed in many references, including U.S. Pat. No. 2,910,377 and JP-B-43-4924 (The term "JP-B" as used herein means an "examined Japanese patent publication").

In general, a silver halide photographic material comprises the foregoing photosensitive layer provided on a support. However, the adhesion between the support and the photosensitive layer is insufficient. Thus, it is practiced to provide a subbing layer on the support on the photosensitive layer side thereof for the purpose of improving the adhesion between the support and the photosensitive layer. Such a subbing layer is formed by applying a coating solution containing a styrene-butadiene copolymer or polyvinylidene chloride to the support. Similarly, JP-A-56-95959 (The term "JP-A" as used herein means an "unexamined published Japanese patent application") proposes a technique involving the provision of a subbing layer containing polyesters on the support on the photosensitive layer side thereof for the purpose of improving the adhesion between the support and the photosensitive layer. Further, JP-A-11-84574 proposes a technique involving the provision of a subbing layer containing a polyester on the support of a photothermographic material on the photosensitive layer side thereof for the purpose of improving the adhesion between the support and the photosensitive layer. However, even when the subbing layer containing a specific aqueous polyester described in JP-A-56-95959 is applied to a photothermographic material, the resulting adhesion between the support and the subbing layer is insufficient. Further, the subbing layer disclosed in JP-A-11-84574, too, gives an insufficient adhesion between the support and the subbing layer, causing insufficiency in the shearing stability of the subbing layer coating solution upon the application of subbing layer and hence causing coating streaks or poor surface conditions.

SUMMARY OF THE INVENTION

An object of the present invention is to solve the foregoing problems with the prior art. In other words, an object of the invention is to solve is to provide a photothermographic image-recording material having a good adhesion between the subbing layer and the support or the image-forming layer.

Another object of the invention is to provide a subbing layer having a good adhesion to the support and image-forming layer, good surface conditions and a good mechanical stability. A further object of the invention is to provide a subbing layer having good surface conditions, i.e., no unevenness, and no streak due to good shearing stability of coating solution thereof for the purpose of obtaining a photothermographic image-recording material having good surface conditions and producibility.

The inventors made extensive studies of solution to the foregoing problems. As a result, it was found that an excellent photothermographic image-recording material having desired effects can be provided by providing at least one subbing layer comprising a polyester on at least one side of a support for photothermographic image-recording material, wherein the polyester is a polyester having a glass transition temperature of from 40° C. to 100° C. comprising an acid component and an alcohol component, the acid component comprises terephthalic acid and/or isophthalic acid in a total amount of from 40 to 90 mol % and isophthalic acid having a sulfonyloxy group represented by a specific structural formula in an amount of from 10 to 60 mol %, and the alcohol component comprises diethylene glycol in an amount of from 40 to 90 mol % and cyclohexane dimethanol in an amount of from 10 to 60 mol %. The present invention has thus been worked out.

The present invention provides a photothermographic image-recording material comprising a support, at least one subbing layer comprising a polyester provided on at least one side of the support and an image-forming layer provided on the subbing layer, wherein the polyester is a polyester having a glass transition temperature of from 40° C. to 100° C. comprising an acid component and an alcohol component, the acid component comprises at least one of terephthalic acid and isophthalic acid in a total amount of from 40 to 90 mol % based on the amount of the acid component and isophthalic acid having a sulfonyloxy group represented by the following formula (1) in an amount of from 10 to 60 mol % based on the amount of the acid component, and the alcohol component comprises diethylene glycol in an amount of from 40 to 90 mol % based on the amount of the alcohol component and cyclohexane dimethanol in an amount of from 10 to 60 mol % based on the amount of the alcohol component:

$$-(SO_3)_nM \quad (1)$$

wherein M represents a hydrogen atom, alkaline or alkaline earth metal or quaternary ammonium residue, and n represents the same number as a valence number of M.

The image-forming layer preferably comprises a photosensitive silver halide, a photoinsensitive organic silver salt, a reducing agent for silver ion and a binder.

DETAILED DESCRIPTION OF THE INVENTION

Methods and embodiments of implication of the present invention will be described in detail hereinafter. The term "from (x) to (y)" as used herein is meant to indicate that x is the lower limit of the range and y is the upper limit of the range, and the lower limit and the upper limit are fallen within the range. That is, the term means "from (x) to (y) both inclusive".

The photothermographic image-recording material according to the invention comprises a support, at least one subbing layer comprising a polyester provided on at least one side of the support and an image-forming layer provided on the subbing layer, wherein the polyester is a polyester having a glass transition temperature (hereinafter occasionally referred to as "Tg") of from 40° C. to 100° C. comprising an acid component and an alcohol component, the acid component comprises at least one of terephthalic acid and isophthalic acid in a total amount of from 40 to 90 mol % based on the amount of the acid component and isophthalic acid having a sulfonyloxy group represented by the following formula (1) in an amount of from 10 to 60 mol % based on the amount of the acid component, and the alcohol component comprises diethylene glycol in an amount of from 40 to 90 mol % based on the amount of the alcohol component and cyclohexane dimethanol in an amount of from 10 to 60 mol % based on the amount of the alcohol component:

$$-(SO_3)_nM \quad (1)$$

wherein M represents a hydrogen atom, alkaline or alkaline earth metal or quaternary ammonium residue, and n represents the same number as a valence number of M.

The polyester to be used in the invention has Tg of from 40° C. to 100° C., preferably from 45° C. to 98° C.

The polyester to be used in the invention contains a structure comprising an ester bond of polyvalent alcohol and polybasic acid. The acid component comprises terephthalic acid and/or isophthalic acid in a total amount of from 40 to 90 mol % based on the amount of the acid component and isophthalic acid having a sulfonyloxy group represented by the formula (1) in an amount of from 10 to 60 mol % based on the amount of the acid component. Terephthalic acid and/or isophthalic acid are preferably used in a total amount of from 65 to 90 mol % based on the amount of the acid component. In this case, the isophthalic acid having a sulfonyloxy group represented by the formula (1) is used in an amount of from 10 to 35 mol % based on the amount of the acid component. The polyvalent alcohol component comprises diethylene glycol in an amount of from 40 to 90 mol % based on the amount of the alcohol component and cyclohexane dimethanol in an amount of from 10 to 60 mol % based on the amount of the alcohol component. Diethylene glycol is preferably used in an amount of from 40 to 75 mol % based on the amount of the alcohol component. In this case, cylohexane dimethanol is used in an amount of from 25 to 60 mol % based on the amount of the alcohol component.

The polyester to be used in the invention can be prepared by any known method. For example, the acid component and the alcohol component may be subjected to a known two-stage process, i.e., esterification starting from free carboxylic acid and polycondensation or ester interchange and polycondensation. The isophthalic acid having a sulfonyloxy group of the formula (1) is prepared under the conditions that M is an alkaline or alkaline earth metal or quaternary ammonium residue.

In the formula (1), M represents a hydrogen atom, alkaline or alkaline earth metal or quaternary ammonium residue. Examples of the alkaline metal represented by M include Li, Na, and K. Examples of the alkaline earth metal represented by M include Mg, and Ca. Examples of the quaternary ammonium residue represented by M include tetraethylammonium, and tetrabutylammonium.

The polyester for use in the present invention is preferably used in an amount such that the thickness of the subbing layer is from 0.05 $\mu$m to 5 $\mu$m, more preferably from 0.1 $\mu$m to 3 $\mu$m per one layer. The polyester is dissolved or dispersed in the solvent for coating solution before use. Examples of the solvent for coating solution employable herein include water, methanol, isopropyl alcohol, and butyl cellosolve. These solvents may be used in admixture.

It is particularly preferred that water be used as a solvent.

As the support employable herein there is preferably used a transparent support, more preferably a transparent polyester support (e.g., polyethylene terephthalate (PET), polyethylene naphthalate). Preferred among these transparent polyester supports is a polyester, particularly polyethylene terephthalate, which has been subjected to heat treatment at a temperature of from 130° C. to 185° C. to relax the internal strain remaining in the film during biaxial orientation and hence eliminate the occurrence of heat shrinkage strain during heat development. In the case of medical photothermographic material, the transparent support may be colored with a blue dye (e.g., Dye-1 disclosed in JP-A-8-240877) or uncolored. The support may comprise as an antistatic layer a layer according to the technique disclosed in JP-A-56-143430, JP-A-56-143431, JP-A-58-62646, JP-A-56-120519, JP-A-11-84573 (paragraphs [0040]-[0051]), U.S. Pat. No. 5,575,957, and JP-A-11-223898 (paragraphs [0078]-[0084]).

The photothermographic image-recording material of the invention may employ undercoating techniques for water-soluble polyester disclosed in JP-A-11-84574, styrene-butadiene copolymer disclosed in JP-A-10-186565 and vinylidene chloride copolymer disclosed in Japanese Patent Application No. 11-106881 (paragraphs [0063]-[0080]) in combination.

The organic silver salt employable herein is a silver salt which is relatively stable to light but forms a silver image when heated to 80° C. or higher in the presence of an exposed photocatalyst (e.g., latent image of photosensitive silver halide) and a reducing agent. The organic silver salt may be an arbitrary organic material containing a source capable of reducing silver ion. For the details of such a photoinsensitive organic silver salt, reference can be made to JP-A-10-62899 (paragraphs [0048]-[0049]), EP-A-0803764 (line 24, page 18—line 37, page 19), and EP-A-0962812.

Preferred among these organic silver salts is a silver salt of organic acid, particularly a silver salt of long-chain aliphatic carboxylic acid (having from 10 to 30, preferably from 15 to 28 carbon atoms). Preferred examples of such an organic silver salt include silver behenate, silver arachidate, silver stearate, silver oleate, silver laurate, silver caproate, silver myristate, silver palmitate, and mixture thereof. In the invention, among these organic silver salts, a silver salt of organic acid having a silver behenate content of not less than 75 mol % is preferably used.

The shape of the organic silver salt to be used in the invention is not specifically limited but may be needle, rod, tablet or scale.

In the invention, a scaly organic silver salt is desirable. In the invention, the scaly organic silver salt is defined as follows. The shape of organic acid silver salt grains observed under electron microscope is approximated to rectangular parallelopiped. Supposing that the length of the sides of the rectangular parallelopiped are a, b, and (b and c may be the same) in order of size, the value of a and b, which are smallest and second smallest, are used to calculate x according to the following equation:

$$x=b/a$$

Thus, about 200 grains are determined for x. These values are then averaged to determine an average x. When x (average) is not smaller than 1.5, the organic silver salt grain is defined to be scaly. The average x is preferably from not smaller than 1.5 to not greater than 30, more preferably from not smaller than 2.0 to not greater than 20. When the average x is from not smaller than 1 to smaller than 1.5, the organic silver salt grain is defined to be acicular.

In the scaly grain, a can be defined to be the thickness of the tabular grain having two main planes formed by the sides b and c. The average of a values is preferably from 0.01 $\mu$m to 0.23 $\mu$m, more preferably from 0.1 $\mu$m to 0.20 $\mu$m. The average of c/b values is preferably from 1 to 6, more preferably from 1.05 to 4, even more preferably from 1.1 to 3, particularly from 1.1 to 2.

The distribution of the grain size of organic silver salt grains is preferably monodisperse. The term "monodisperse" as used herein is meant to indicate that the percentage obtained by dividing the standard deviation of the length of major axis and minor axis by the length of major axis and minor axis, respectively, are preferably not greater than 100%, more preferably not greater than 80%, even more preferably not greater than 50%. For the measurement of the shape of organic silver salt grains, the transmission type electron microscopic image of the organic silver salt grains in the form of dispersion can be used. Another method for the measurement of monodispersibility is to determine the standard deviation of volume weighted average grain diameter of organic silver salt grains. The percentage (coefficient of variation) obtained by dividing the standard deviation by volume weighted average grain diameter is preferably not greater than 100%, more preferably not greater than 80%, even more preferably not greater than 50%. Referring further to measuring method, the organic silver salt grains dispersed in a solution are irradiated with laser beam. The autocorrelation function with respect to the change of fluctuation of the resulting scattered light with time is then determined to obtain grain size (volume weighted average grain diameter) from which the standard deviation of volume weighted average grain diameter can then be determined.

The preparation and dispersion of the organic silver salt to be used in the invention can be accomplished by any known method. For the details of this method, reference can be made to the above cited JP-A-10-62899, and EP-A-0803763 and EP-A-962812.

When a photosensitive silver salt is present during the dispersion of organic silver salt, fogging occurs more, drastically lowering the sensitivity. Thus, it is preferred that substantially no photosensitive silver salt be present during dispersion. In the invention, the amount of photosensitive silver salt in the aqueous dispersion to be dispersed is not greater than 0.1 mol % per mol of organic acid silver salt in the dispersion. Thus, the addition of photosensitive silver salt is not positively conducted.

In the invention, an aqueous dispersion of organic silver salt and an aqueous dispersion of photosensitive silver salt can be mixed to prepare a photosensitive material. The mixing ratio of organic silver salt and photosensitive silver salt may be predetermined depending on the purpose. In practice, however, the ratio of photosensitive silver to organic silver salt is preferably from 1 to 30 mol %, more preferably from 3 to 20 mol %, particularly from 5 to 15 mol %. To mix two or more aqueous dispersions of organic silver salt with two or more aqueous dispersions of photosensitive silver salt is a method that can be preferably used to adjust the photographic properties.

The organic silver salt to be used in the invention can -be used in a desired amount, preferably from 0.1 to 5 g/m$^2$, more preferably from 1 to 3 g/m$^2$ as calculated in terms of silver.

The photothermographic image-recording material of the invention preferably comprises a reducing agent for organic silver salt incorporated therein. The reducing agent for organic silver salt may be an arbitrary material which reduces silver ion to metallic silver (preferably organic material) . For the details of such a reducing agent, reference can be made to JP-A-11-65021 (paragraphs [0043]-[0045]) and EP-A-0803764 (line 34, page 7—line 12, page 18).

The reducing agent to be used in the invention is preferably a bisphenol-based reducing agent, more preferably a compound represented by the following formula (I):

(I)

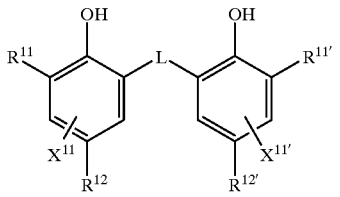

wherein $R^{11}$ and $R^{11'}$ each independently represents a $C_{1-20}$ alkyl group; $R^{12}$ and $R^{12'}$ each independently represents a hydrogen atom or a substituent which can substitute on a benzene ring; L represents -S- group or —$CHR^{13}$- group in which $R^{13}$ represents a hydrogen atom or $C_{1-20}$ alkyl group; and $X^{11}$ and $X^{11'}$ each independently represents a hydrogen atom or a substituent which can substitute on a benzene ring.

The formula (I) will be further described hereinafter.

$R^{11}$ and $R^{11'}$ each independently represents a substituted or unsubstituted $C_{1-20}$ alkyl group. The substituents on the alkyl group represented by $R^{11}$ and $R^{11'}$ are not specifically limited. Examples of the substituents employable herein include aryl group, hydroxyl group, alkoxy group, aryloxy group, alkylthio group, arylthio group, acylamino group, sulfonamido group, sulfonyl group, phosphoryl group, acyl group, carbamoyl group, ester group, and halogen atom.

$R^{12}$ and $R^{12'}$ each independently represents a hydrogen atom or a substituent which can substitute on a benzene ring.

$X^{11}$ and $X^{11'}$, too, each independently represents a hydrogen atom or a substituent which can substitute on a benzene ring. Examples of the group which can substitute on a benzene ring include alkyl group, aryl group, halogen atom, alkoxy group, and acylamino group.

$R^{11}$ or $R^{12}$ and $X^{11}$, or $R^{11'}$ or $R^{12'}$ and $X^{11'}$ may together form a ring structure. Examples of the ring structure include a hydrocarbon ring which may have substituents.

L represents -S- group or —$CHR^{13}$- group. $R^{13}$ represents a hydrogen atom or $C_{1-20}$ alkyl group which may have substituents. Specific examples of the unsubstituted alkyl group represented by $R^{13}$ include methyl group, ethyl group, propyl group, butyl group, heptyl group, undecyl group, isopropyl group, 1-ethylpentyl group, and 2,4,4-trimethylpentyl group. Examples of the substituents on the alkyl group represented by $R^{13}$ include those described with reference to the substituents on the alkyl group represented by $R^{11}$, e.g., halogen atom, alkoxy group, alkylthio group, aryloxy group, arylthio group, acylamino group, sulfonamido group, sulfonyl group, phosphoryl group, oxycarbonyl group, carbamoyl group, sulfamoyl group.

$R^{11}$ and $R^{11'}$ each is preferably a $C_{3-15}$ secondary or tertiary alkyl group. Specific examples of such an alkyl group include isopropyl group, isobutyl group, t-butyl group, t-amyl group, t-octyl group, cyclohexyl group, cyclopentyl group, 1-methylcylohexyl group, and 1-methylcyclopropyl group. Even more desirable from the groups represented by $R^{11}$ or $R^{11'}$ are $C_{4-12}$ tertiary alkyl groups. Still even more desirable from these alkyl groups are t-butyl group, t-amyl group, and 1-methylcyclohexyl group. Most desirable from these alkyl groups is t-butyl group.

$R^{12}$ and $R^{12}$ each are preferably a $C_{1-20}$ alkyl group. Specific examples of such an alkyl group include methyl group, ethyl group, propyl group, butyl group, isopropyl group, t-butyl group, t-amyl group, cyclohexyl group, 1-methylcyclohexyl group, benzyl group, methoxymethyl group, and methoxyethyl group. Preferred among these alkyl groups are methyl group, ethyl group, propyl group, isopropyl group, and t-butyl group.

$X^{11}$ and $X^{11'}$ each are preferably a hydrogen atom, halogen atom or alkyl group, more preferably hydrogen atom.

L is preferably —$CHR^{13}$- group.

$R^{13}$ is preferably a hydrogen atom or $C_{1-15}$ alkyl group. Preferred examples of the alkyl group include methyl group, ethyl group, propyl group, isopropyl group, and 2,4,4-trimethylpentyl group. Particularly preferred among these alkyl groups are hydrogen atom, methyl group, ethyl group, and propyl group.

When $R^{13}$ is a hydrogen atom, $R^{12}$ and $R^{12'}$ each is preferably a $C_{2-5}$ alkyl group, more preferably ethyl group or propyl group, most preferably ethyl group.

When $R^{13}$ is a $C_{1-8}$ primary or secondary alkyl group, $R^{12}$ and $R^{12'}$ each is preferably a methyl group. Preferred examples of the $C_{1-8}$ primary or secondary alkyl group represented by $R^{13}$ include methyl group, ethyl group, propyl group, and ispropyl group. Even more preferable from these alkyl groups are methyl group, ethyl group, and propyl group.

Specific examples of the compound represented by the formula (I) to be used in the invention will be given below, but the present invention should not be construed as being limited thereto.

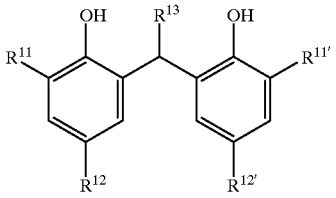

| | $R^{11}$ | $R^{11'}$ | $R^{12}$ | $R^{12'}$ | $R^{13}$ |
|---|---|---|---|---|---|
| I-1 | $CH_3$ | $CH_3$ | $CH_3$ | $CH_3$ | H |
| I-2 | $CH_3$ | $CH_3$ | $CH_3$ | $CH_3$ | $CH_3$ |
| I-3 | $CH_3$ | $CH_3$ | $CH_3$ | $CH_3$ | $C_3H_7$ |
| I-4 | $CH_3$ | $CH_3$ | $CH_3$ | $CH_3$ | i-$C_3H_7$ |
| I-5 | $CH_3$ | $CH_3$ | $CH_3$ | $CH_3$ | $CH(C_2H_5)C_4H_9$ |
| I-6 | $CH_3$ | $CH_3$ | $CH_3$ | $CH_3$ | $CH_2CH(CH_3)CH_2C(CH_3)_3$ |
| I-7 | $CH_3$ | $CH_3$ | $C_2H_5$ | $C_2H_5$ | H |
| I-8 | $CH_3$ | $CH_3$ | $C_2H_5$ | $C_2H_5$ | i-$C_3H_7$ |
| I-9 | $C_2H_5$ | $C_2H_5$ | $CH_3$ | $CH_3$ | H |
| I-10 | $C_2H_5$ | $C_2H_5$ | $CH_3$ | $CH_3$ | i-$C_3H_7$ |
| I-11 | t-$C_4H_9$ | t-$C_4H_9$ | $CH_3$ | $CH_3$ | H |
| I-12 | t-$C_4H_9$ | t-$C_4H_9$ | $CH_3$ | $CH_3$ | $CH_3$ |
| I-13 | t-$C_4H_9$ | t-$C_4H_9$ | $CH_3$ | $CH_3$ | $C_2H_5$ |
| I-14 | t-$C_4H_9$ | t-$C_4H_9$ | $CH_3$ | $CH_3$ | n-$C_3H_7$ |
| I-15 | t-$C_4H_9$ | t-$C_4H_9$ | $CH_3$ | $CH_3$ | n-$C_4H_9$ |
| I-16 | t-$C_4H_9$ | t-$C_4H_9$ | $CH_3$ | $CH_3$ | n-$C_7H_{15}$ |
| I-17 | t-$C_4H_9$ | t-$C_4H_9$ | $CH_3$ | $CH_3$ | n-$C_{11}H_{21}$ |
| I-18 | t-$C_4H_9$ | t-$C_4H_9$ | $CH_3$ | $CH_3$ | i-$C_3H_7$ |
| I-19 | t-$C_4H_9$ | t-$C_4H_9$ | $CH_3$ | $CH_3$ | $CH(C_2H_5)C_4H_9$ |
| I-20 | t-$C_4H_9$ | t-$C_4H_9$ | $CH_3$ | $CH_3$ | $CH_2CH(CH_3)_2$ |
| I-21 | t-$C_4H_9$ | t-$C_4H_9$ | $CH_3$ | $CH_3$ | $CH_2CH(CH_3)CH_2C(CH_3)_3$ |
| I-22 | t-$C_4H_9$ | t-$C_4H_9$ | $CH_3$ | $CH_3$ | $CH_2OCH_3$ |
| I-23 | t-$C_4H_9$ | t-$C_4H_9$ | $CH_3$ | $CH_3$ | $CH_2CH_2OCH_3$ |
| I-24 | t-$C_4H_9$ | t-$C_4H_9$ | $CH_3$ | $CH_3$ | $CH_2CH_2OC_4H_9$ |
| I-25 | t-$C_4H_9$ | t-$C_4H_9$ | $CH_3$ | $CH_3$ | $CH_2CH_2SC_{12}H_{25}$ |
| I-26 | t-$C_4H_9$ | t-$C_4H_9$ | $C_2H_5$ | $C_2H_5$ | H |
| I-27 | t-$C_4H_9$ | t-$C_4H_9$ | $C_2H_5$ | $C_2H_5$ | $CH_3$ |
| I-28 | t-$C_4H_9$ | t-$C_4H_9$ | $C_2H_5$ | $C_2H_5$ | n-$C_3H_7$ |
| I-29 | t-$C_4H_9$ | t-$C_4H_9$ | $C_2H_5$ | $C_2H_5$ | i-$C_3H_7$ |
| I-30 | t-$C_4H_9$ | t-$C_4H_9$ | $C_2H_5$ | $C_2H_5$ | $CH_2CH_2OCH_3$ |
| I-31 | t-$C_4H_9$ | t-$C_4H_9$ | n-$C_3H_7$ | n-$C_3H_7$ | H |
| I-32 | t-$C_4H_9$ | t-$C_4H_9$ | n-$C_3H_7$ | n-$C_3H_7$ | $CH_3$ |
| I-33 | t-$C_4H_9$ | t-$C_4H_9$ | n-$C_3H_7$ | n-$C_3H_7$ | n-$C_3H_7$ |
| I-34 | t-$C_4H_9$ | t-$C_4H_9$ | n-$C_4H_9$ | n-$C_4H_9$ | H |
| I-35 | t-$C_4H_9$ | t-$C_4H_9$ | n-$C_4H_9$ | n-$C_4H_9$ | $CH_3$ |
| I-36 | t-$C_5H_{11}$ | t-$C_5H_{11}$ | $CH_3$ | $CH_3$ | H |
| I-37 | t-$C_5H_{11}$ | t-$C_5H_{11}$ | $CH_3$ | $CH_3$ | $CH_3$ |
| I-38 | t-$C_5H_{11}$ | t-$C_5H_{11}$ | $C_2H_5$ | $C_2H_5$ | H |
| I-39 | t-$C_5H_{11}$ | t-$C_5H_{11}$ | $C_2H_5$ | $C_2H_5$ | $CH_3$ |
| I-40 | i-$C_3H_7$ | i-$C_3H_7$ | $CH_3$ | $CH_3$ | H |
| I-41 | i-$C_3H_7$ | i-$C_3H_7$ | $CH_3$ | $CH_3$ | n-$C_3H_7$ |
| I-42 | i-$C_3H_7$ | i-$C_3H_7$ | $C_2H_5$ | $C_2H_5$ | H |
| I-43 | i-$C_3H_7$ | i-$C_3H_7$ | $C_2H_5$ | $C_2H_5$ | n-$C_3H_7$ |
| I-44 | i-$C_3H_7$ | i-$C_3H_7$ | i-$C_3H_7$ | i-$C_3H_7$ | H |
| I-45 | i-$C_3H_7$ | i-$C_3H_7$ | i-$C_3H_7$ | i-$C_3H_7$ | $CH_3$ |
| I-46 | i-$C_4H_9$ | $CH_3$ | $CH_3$ | $CH_3$ | H |
| I-47 | i-$C_4H_9$ | $CH_3$ | $CH_3$ | $CH_3$ | $CH_3$ |
| I-48 | i-$C_4H_9$ | $CH_3$ | $CH_3$ | $CH_3$ | n-$C_3H_7$ |
| I-49 | i-$C_4H_9$ | $CH_3$ | t-$C_4H_9$ | $CH_3$ | $CH_3$ |
| I-50 | i-$C_3H_7$ | $CH_3$ | $CH_3$ | $CH_3$ | $CH_3$ |

I-51

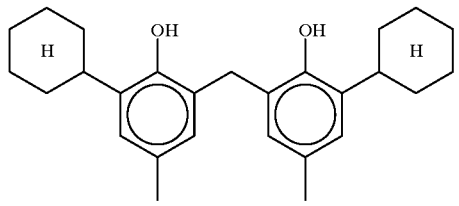

-continued
I-52
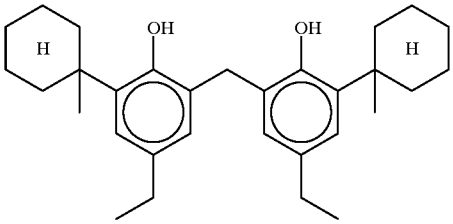
I-53
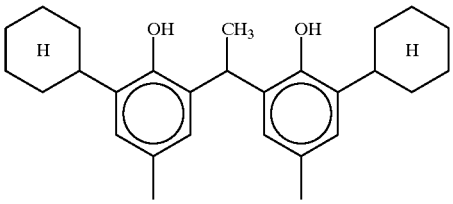
I-54
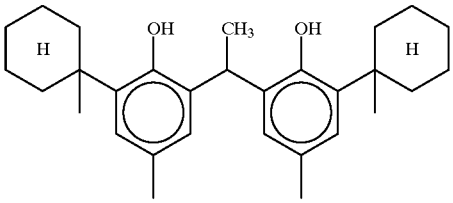
I-55
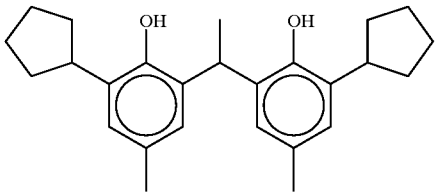
I-56
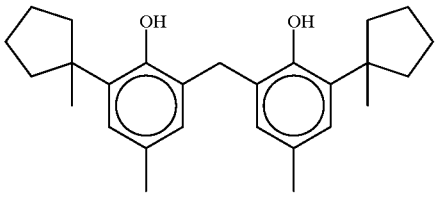
I-57
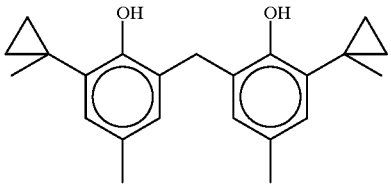
I-58
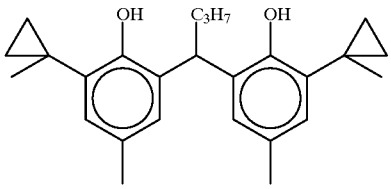
-continued
I-59
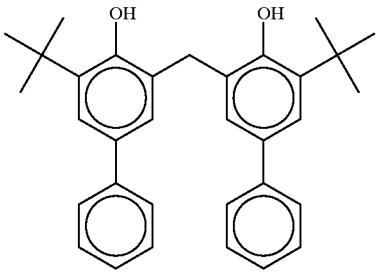
I-60
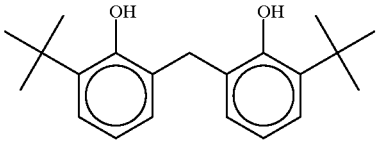
I-61
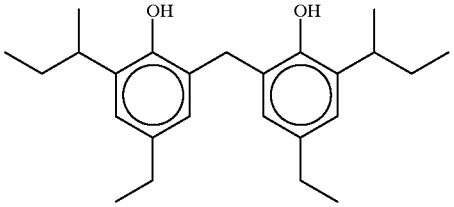
I-62
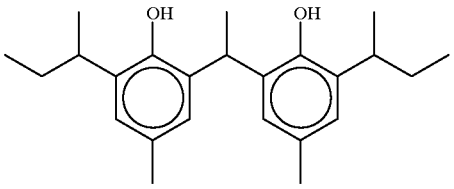
I-63
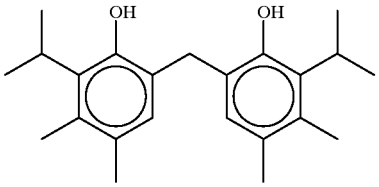
I-64
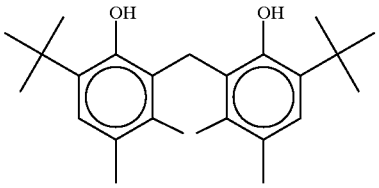
I-65
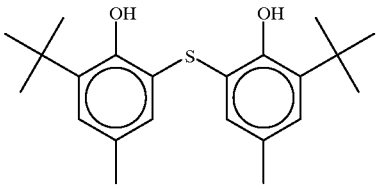

-continued

I-66

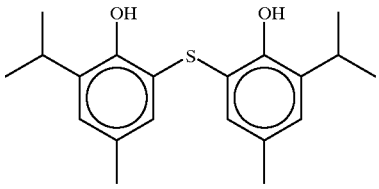

I-67

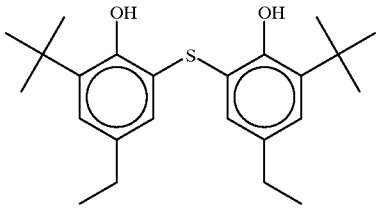

I-68

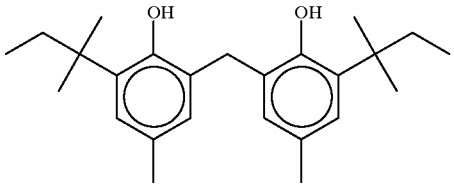

I-69

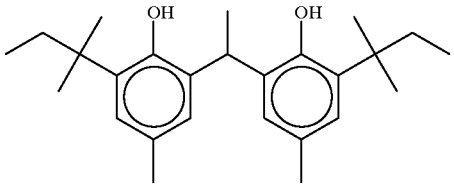

I-70

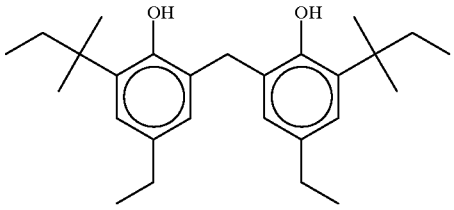

I-71

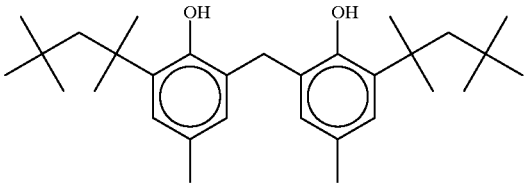

I-72

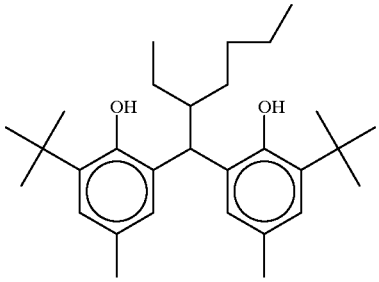

-continued

I-73

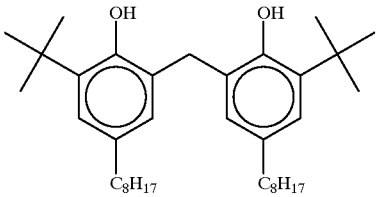

I-74

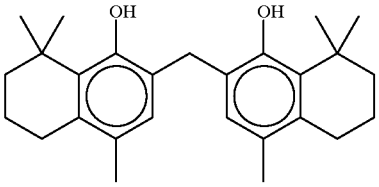

I-75

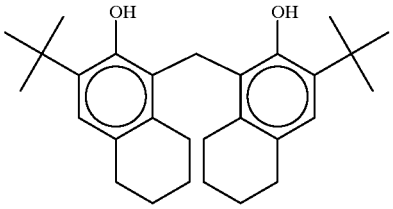

I-76

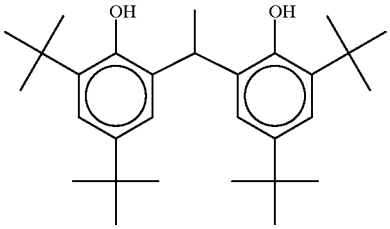

In the invention, the added amount of the reducing agent is preferably from 0.01 to 5.0 g/m$^2$, more preferably from 0.1 to 3.0 g/m$^2$, or preferably from 5 to 50 mol %, more preferably from 10 to 40 mol % per mol of silver on the surface having an image-forming layer. The reducing agent is preferably incorporated in the image-forming layer.

The reducing agent may be contained in the coating solution in any form such as solution, emulsion dispersion and dispersion of solid grains before being incorporated in the photosensitive material.

One of well known emulsion dispersion methods is a method which comprises dissolving the reducing agent in an oil such as dibutyl phthalate, tricresyl phosphate, glyceryl triacetate and diethyl phthalate or auxiliary solvent such as ethyl acetate and cyclohexanone, and then subjecting the solution to mechanical emulsion dispersion.

As one of solid grain dispersion methods there may be used a method which comprises subjecting a reducing agent powder to dispersion in a proper solvent such as water using a ball mill, colloid mill, oscillating ball mill, sand mill, jet mill, roller mill or ultrasonic wave to prepare a solid dispersion. The preparation of solid dispersion may be assisted by the use of a protective colloid (e.g., polyvinyl alcohol) or a surface active agent (e.g., anionic surface active agent such as sodium triisopropylnaphthalenesulfonate (mixture of three sodium triisopropylnaphthalenesulfonates having different isopropyl group substitution positions)). The aqueous dispersion may comprise a preservative (e.g., sodium salt of benzoisothiazolinone) incorporated therein.

The photothermographic image-recording material of the invention preferably comprises as a development accelerator a phenol derivative represented by the formula (A) described in JP-A-2000-267222 incorporated therein.

In the case where the reducing agent of the invention has an aromatic hydroxyl group (—OH), particularly the foregoing bisphenol, a non-reducing compound having a group capable of forming a hydrogen bond with such an aromatic hydroxyl group is preferably used as well. Examples of the group which forms a hydrogen bond with a hydroxyl group or amino group include phosphoryl group, sulfoxide group, sulfonyl group, carbonyl group, amido group, ester group, urethane group, ureido group, tertiary amino group, and nitrogen-containing aromatic group. Preferred among these non-reducing compounds are those having phosphoryl group, sulfoxido group, amido group (free of >N-H group but is blocked as >N-R (in which R is a substituent other than H)), urethane group (free of >N-H group but is blocked as >N-R (in which R is a substituent other than H)), and ureido group (free of >N-H group but is blocked as >N-R (in which R is a substituent other than H)).

In the invention, a particularly preferred hydrogen-bonding compound is one represented by the following formula (II):

(II)

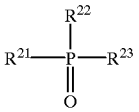

In the formula (II), $R^{21}$ to $R^{23}$ each independently represents an alkyl group, aryl group, alkoxy group, aryloxy group, amino group or heterocyclic group which may be substituted or unsubstituted. Examples of the substituents, if any on $R^{21}$ to $R^{23}$, include halogen atom, alkyl group, aryl group, alkoxy group, amino group, acyl group, acylamino group, alkylthio group, arylthio group, sulfonamido group, acyloxy group, oxycarbonyl group, carbamoyl group, sulfamoyl group, sulfonyl group, and phosphoryl group. Preferred among these substituents is alkyl group or aryl group such as methyl, ethyl, isopropyl, t-butyl, t-octyl, phenyl, 4-alkoxyphenyl and 4-acyloxyphenyl.

Specific examples of the alkyl group represented by $R^{21}$ to $R^{23}$ include methyl group, ethyl group, butyl group, octyl group, dodecyl group, isopropyl group, t-butyl group, t-amyl group, t-octyl group, cyclohexyl group, 1-methylcylohexyl group, benzyl group, phenethyl group, and 2-phenoxypropyl group. Specific examples of the aryl group represented by $R^{21}$ to $R^{23}$ include phenyl group, cresyl group, xylyl group, naphthyl group, 4-t-butylphenyl group, 4-t-octylphenyl group, 4-anisidyl group, and 3,5-dichlorophenyl group. Specific examples of the alkoxy group represented by $R^{21}$ to $R^{23}$ include methoxy group, ethoxy group, butoxy group, octyloxy group, 2-ethylhexyloxy group, 3,5,5-trimethylhexyloxy group, dodecyloxy group, cyclohexyloxy group, 4-methylcyclohexyloxy group, and benzyloxy group. Specific examples of the aryloxy group represented by $R^{21}$ to $R^{23}$ include phenoxy group, cresyloxy group, isopropylphenoxy group, 4-t-butylphenoxy group, naphthoxy group, and biphenyloxy group. Specific examples of the amino group represented by $R^{21}$ to $R^{23}$ include dimethylamino group, diethylamino group, dibutylamino group, dioctylamino group, N-methyl-N-hexylamino group, dicyclohexylamino group, diphenylamino group, and N-methyl-N-phenylamino group.

$R^{21}$ and $R^{22}$, $R^{22}$ and $R^{23}$ or $R^{21}$, $R^{22}$ and $R^{23}$ may together represent a monocyclic or polycyclic hydrocarbon which may be substituted.

$R^{21}$ to $R^{23}$ each are preferably an alkyl group, aryl group, alkoxy group or aryloxy group. In the light of the effect of the invention, at least one of $R^{21}$ to $R^{23}$ is preferably an alkyl or aryl group. More preferably, two or more of $R^{21}$ to $R^{23}$ each are an alkyl or aryl group. In the light of availability and inexpensiveness, it is preferred that $R^{21}$ to $R^{23}$ be the same.

Specific examples of the compound of the formula (II) employable herein include will be given below, but the present invention should not be construed as being limited thereto.

(II-1)

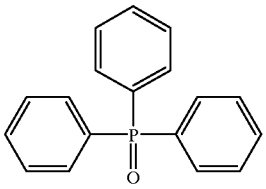

(II-2)

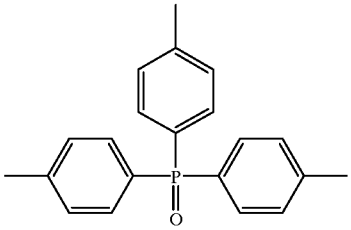

(II-3)

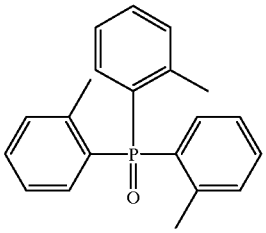

(II-4)

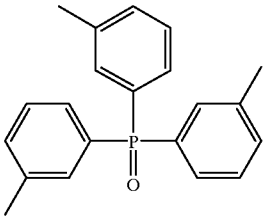

(II-5)

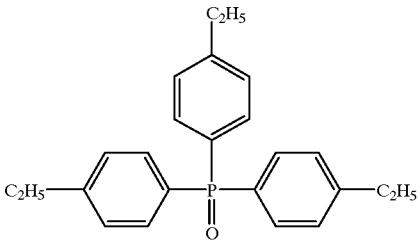

-continued
(II-6)
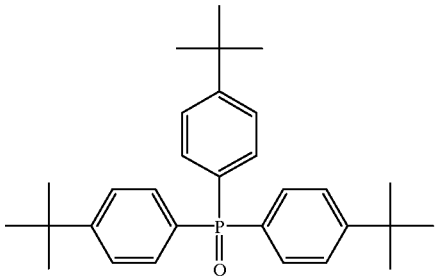
(II-7)
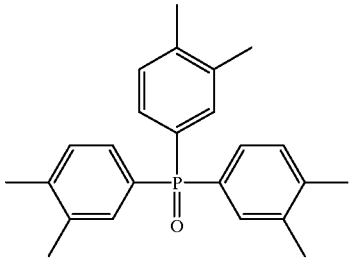
(II-8)
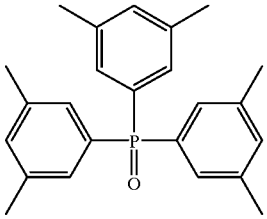
(II-9)
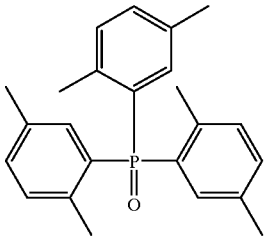
(II-10)
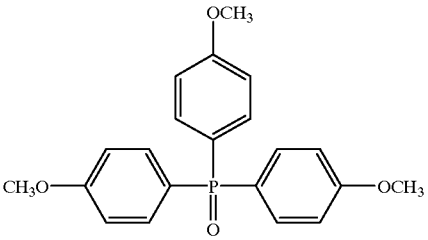
(II-11)
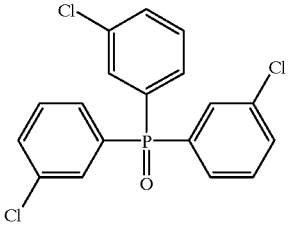
-continued
(II-12)
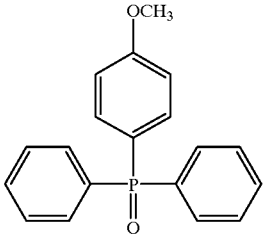
(II-13)
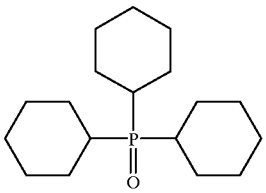
(II-14)
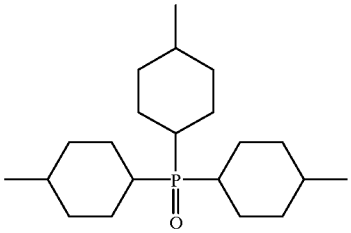
(II-15)
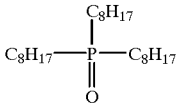
(II-16)
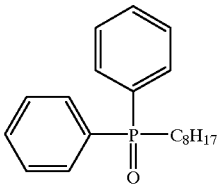
(II-17)
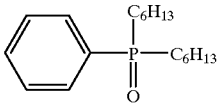
(II-18)
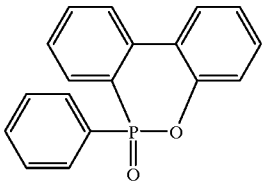
(II-19)
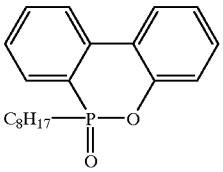

-continued
(II-20)
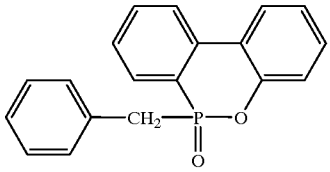
(II-21)
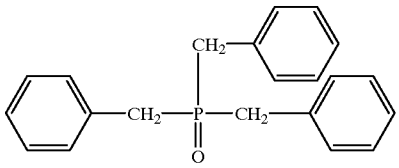
(II-22)
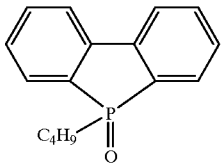
(II-23)
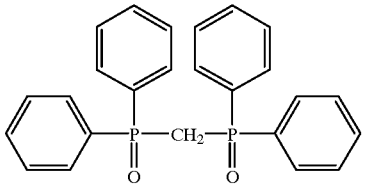
(II-24)
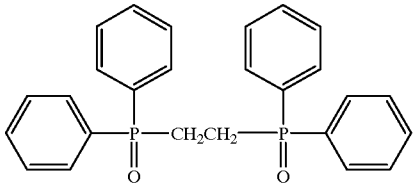
(II-25)
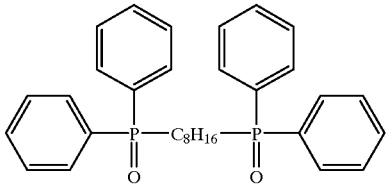
(II-26)
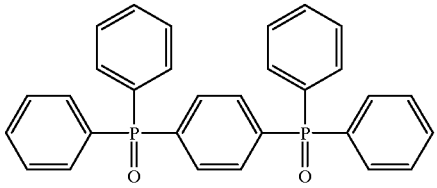
-continued
(II-27)
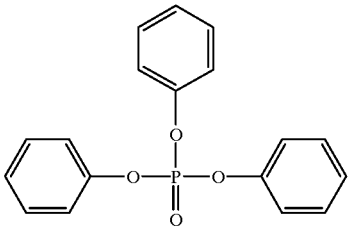
(II-28)
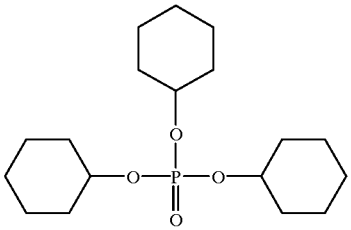
(II-29)
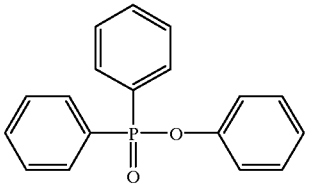
(II-30)
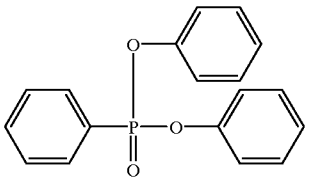
(II-31)
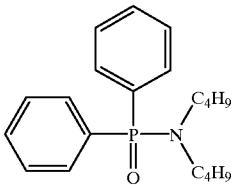
(II-32)
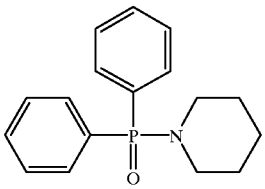
(II-33)
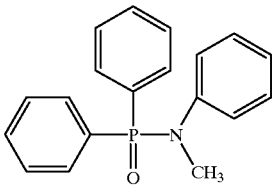

-continued (II-34)

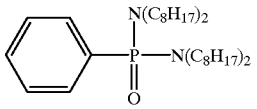

(II-35)

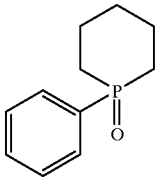

(II-36)

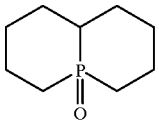

(II-37)

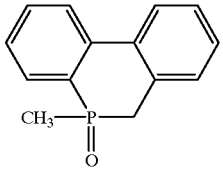

(II-38)

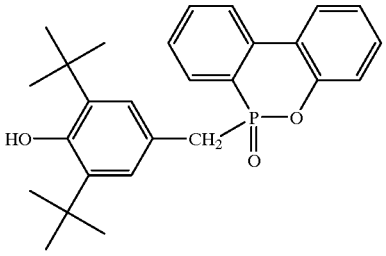

(II-39)

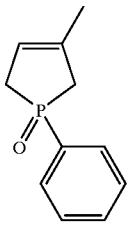

(II-40)

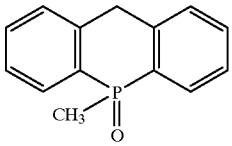

The compound of the formula (II) to be used in the invention may be contained in the coating solution in the form of solution, emulsion dispersion or dispersion of solid grains before being incorporated in the image-recording material similarly to the reducing agent. The compound of the formula (II), if in the form of solution, forms a hydrogen-bonding complex with a compound having a phenolic hydroxyl group and an amino group and thus can be isolated as a complex in crystalline form depending on the combination with the reducing agent used. The use of the crystal powder thus isolated as a dispersion of solid grains is particularly preferred for the provision of stabilized properties. Alternatively, a method may be preferably used which comprises mixing the reducing agent and the compound of the formula (II) in powder form, and then subjecting the mixture to dispersion by a sand grinder mill or the like with a proper dispersant to cause complexing.

The compound of the formula (II) of the invention is preferably used in an amount of from 1 to 200 mol %, more preferably from 10 to 150 mol %, even more preferably from 30 to 100 mol % based on the reducing agent.

The image-forming layer of the photothermographic image-recording material of the invention preferably comprises a photosensitive silver halide incorporated therein.

The photosensitive silver halide to be used in the invention is not specifically limited in halogen composition. Examples of the photosensitive silver halide employable herein include silver chloride, silver bromochloride, silver bromide, silver bromoiodide, and silver bromochloroiodide. The distribution of halogen composition in the photosensitive silver halide grain may be uniform or change stepwise or continuously. A silver halide grain having a core/shell structure is preferably used. The core/shell grain preferably has a double to quintuple, more preferably a double to quadruplex structure. Further, a technique for localizing silver bromide on the surface of silver chloride or silver bromochloride grain is preferably used.

Methods for forming a photosensitive silver halide are well known in the art. For example, methods disclosed in Research Disclosure No. 17029, June 1978, and U.S. Pat. No. 3,700,458 may be used. In some detail, a method may be used which comprises adding a silver-supplying compound and a halogen-supplying compound to gelatin or polymer solution to prepare a photosensitive silver halide, and then mixing the photosensitive silver halide with an organic silver salt. Other preferred examples of the method for forming a photosensitive silver halide include those disclosed in JP-A-11-119374 (paragraphs [0217]-[0224]), JP-A-11-352627 and Japanese Patent Application No. 11-84182.

The grain size of the photosensitive silver halide is preferably small for the purpose of minimizing clouding after image formation. In some detail, the grain size of the photosensitive silver halide is preferably not greater than 0.20 $\mu$m, more preferably from 0.01 $\mu$m to 0.15 $\mu$m, even more preferably from 0.02 $\mu$m to 0.12 $\mu$m. The term "grain size" as used herein is meant to indicate the diameter of circle having the same area as the projected area (projected area of main plane, if the grain is tabular) of silver halide grain.

Examples of the crystal form of silver halide grain include cube, octahedron, tablet, sphere, rod, and pebble-like form. In the invention, cubic grain is particularly preferred. A silver halide grain having rounded corners is also preferred. The index (Millor index) of the outer surface of the photosensitive silver halide grain is not specifically limited. In practice, however, it is preferred that the proportion of {100} plane having a high spectral sensitization efficiency upon adsorption of spectral sensitizing dye be as high as not lower than 50%, more preferably not lower than 65%, even more preferably not lower than 80%. The proportion of {100} plane with respect to Millor index can be determined by the method described in T. Tani; J. Imaging Sci., 29, 165 (1985) utilizing the dependence of adsorption of sensitizing dye by {111} plane and {100} plane.

In the invention, a silver halide grain having a hexacyano metal complex present on the outermost surface thereof is preferred. Examples of such a hexacyano metal complex include $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$, and $[Re(CN)_6]^{3-}$. In the invention, hexacyano-Fe complex is preferred.

Since such a hexacyano metal complex occurs in the form of ion in an aqueous solution, the counter cation is not important. Alkaline metal ions such as sodium ion, potassium ion, rubidium ion, cesium ion and lithium ion, ammonium ion, and alkyl ammonium ion (e.g., tetramethyl ammonium ion, tetraethyl ammonium ion, tetrapropyl ammonium ion, tetra(n-butyl) ammonium ion), which are miscible with water and suitable for the precipitation of silver halide emulsion, are preferably used.

The hexacyano metal complex may be added to the silver halide grain in admixture with a mixture of water and an organic solvent miscible with water (e.g., alcohol, ether, glycol, ketone, ester, amide) or gelatin.

The added amount of the hexacyano metal complex is preferably from $1\times10^{-5}$ mol to $1\times10^{-2}$ mol, more preferably from $1\times10^{-4}$ mol to $1\times10^{-3}$ mol per mol of silver.

In order to allow the hexacyano metal complex to present on the outermost surface of the silver halide grain, the hexacyano metal complex may be added as it is before the termination of charging step after the termination of addition of the aqueous solution of silver nitrate to be used for the formation of grains up to chemical sensitization step for effecting noble metal sensitization such as gold sensitization, etc. or chalcogen sensitization such as sulfur sensitization, selenium sensitization and tellurium sensitization; during rinsing step; during dispersion step; or before chemical sensitization step. In order to prevent the growth of finely divided grains of silver halide, it is preferred that the hexacyano metal complex be added soon after the formation of grains, more preferably before the termination of charging step.

The addition of the hexacyano metal complex may begin after the addition of silver nitrate to be added for the formation of grains in an amount of 96% by weight, preferably 98% by weight, particularly preferably 99% by weight based on the desired total amount to be added.

When the hexacyano metal complex is added after the addition of the aqueous solution of silver nitrate shortly before the completion of formation of grains, it can be adsorbed to the outermost surface of the silver halide grains. Most of the hexacyano metal complex thus added forms a difficultly-soluble salt with silver ion on the surface of the grains. Since the silver salt of hexacyano ferric iron (II) is more difficultly soluble than AgI, the redissolution by fine grains can be prevented, making it possible to prepare finely divided grains of silver halide having a small grain size.

The photosensitive silver halide grain to be used in the invention may comprise a metal belonging to the groups 8 to 10 of the periodic table (containing the groups 1 to 18) or complex thereof incorporated therein. Preferred examples of the central metal in the metal belonging to the groups 8 to 10 of the periodic table or complex thereof include rhodium, ruthenium, and iridium. These metal complexes may be singly used. Alternatively, two or more of the same or different kinds of metal complexes may be used. The content of these metal complexes is preferably from $1\times10^{-9}$ mol to $1\times10^{-3}$ mol per mol of silver. For the details of these heavy metals, metal complexes and methods for the addition thereof, reference can be made to JP-A-7-225449, JP-A-11-65021 (paragraphs [0018]-[0024]), and JP-A-11-119374 (paragraphs [0227]-[0240]).

For the details of metal atoms which can be incorporated in the silver halide grains to be used in the invention (e.g., $[Fe(CN)_6]^{4-}$), methods for desalting silver halide emulsion and methods for chemical sensitization of silver halide emulsion, reference can be made to JP-A-11-84574 (paragraphs [0046]-[0050]), JP-A-11-65021 (paragraphs [0025]-[0031]), and JP-A-11-119374 (paragraphs [0242]-[0250]).

As gelatin to be incorporated in the photosensitive silver halide emulsion of the invention there may be used any kind of gelatin. In order to keep the photosensitive silver halide emulsion dispersed fairly in the organic silver salt-containing coating solution, a low molecular gelatin having a molecular weight of from 500 to 60,000 is preferably used. Such a low molecular gelatin may be used during the formation of grains or during dispersion after desalting, preferably during dispersion after desalting.

As the sensitizing dye to be used in the invention there may be selected to advantage a sensitizing dye which can spectrally sensitize silver halide grains in the desired wavelength range and has a spectral sensitivity adapted for the spectral properties of the exposing light source when the sensitizing dye is adsorbed on the silver halide grains. For the details of these sensitizing dyes and methods for the addition thereof, reference can be made to JP-A-11-65021 (paragraphs [0103]-[0109]), compound represented by the formula (II) described in JP-A-10-186572, dyes represented by the formula (I) described in JP-A-11-119374 and paragraph [0106] thereof, U.S. Pat. No. 5,510,236, dyes described in Example 5 of U.S. Pat. No. 3,871,887, JP-A-2-96131, dyes disclosed in JP-A-59-48753, EP-A-0803764 (line 38, page 19—line 35, page 20), and Japanese Patent Application Nos. 2000-86865 and 2000-102560. These sensitizing dyes may be used singly or in combination of two or more thereof. In the invention, the time at which the sensitizing dye is added to the silver halide emulsion is preferably between after desalting step and coating, more preferably between after desalting and beginning of chemical ripening.

The amount of the sensitizing dye to be added in the invention may be predetermined to be a desired value according to the sensitivity or fogging. In practice, however, it is preferably from $10^{-6}$ mol to 1 mol, more preferably from $10^{-4}$ mol to $10^{-1}$ mol per mol of silver halide in the photosensitive layer.

In the invention, a supersensitizer can be used to enhance the spectral sensitization efficiency. Examples of the supersensitizer employable herein include compounds disclosed in EP-A-587338, U.S. Pat. Nos. 3,877,943 and 4,873,184, JP-A-5-341432, JP-A-11-109547, and JP-A-10-111543.

The photosensitive silver halide grains to be used in the invention has preferably been subjected to chemical sensitizing such as sulfur sensitization, selenium sensitization and tellurium sensitization. As the compound which can be preferably used in sulfur sensitization, selenium sensitization and tellurium sensitization there may be used any known compound as disclosed in JP-A-7-128768. Particularly preferred among these chemical sensitization methods is tellurium sensitization. More preferably, compounds disclosed in literatures disclosed in paragraph [0030] of JP-A-11-65021 and compounds of the formulae (II), (III) and (IV) disclosed in JP-A-5-313284 are used.

In the invention, chemical sensitization may be conducted at any time after grain formation and before coating, and it can be conducted after desalting, e.g., (1) before spectral sensitization, (2) at the same time with spectral sensitization, (3) after spectral sensitization, (4) shortly before coating. In particular, it can preferably be conducted after spectral sensitization.

The amount of sulfur, selenium or tellurium sensitizer to be used in the invention depends on the silver halide grain used, chemical ripening conditions, etc. In practice, however, it is from $10^{-8}$ mol to $10^{-2}$ mol, preferably from $10^{-7}$ mol to $10^{-3}$ mol per mol of silver halide. The chemical sensitizing conditions in the invention are not specifically limited. In practice, however, chemical sensitizing is preferably conducted at a pH value of from 5 to 8, a pAg value of from 6 to 11 and a temperature of from about 40° C. to 95° C.

To the silver halide emulsion to be used in the invention may be added a thiosulfonic acid compound by the method disclosed in EP-A-293917.

The photosensitive material of the invention may comprise one photosensitive silver halide emulsion or two or more photosensitive silver halide emulsions (e.g., those having different average grain sizes, different halogen compositions, different crystal habits or different chemical sensitizing conditions) in combination incorporated therein. The use of a plurality of photosensitive silver halides having different sensitivities makes it possible to adjust gradation. For the details of techniques concerning photosensitive silver halide emulsions, reference can be made to JP-A-57-119341, JP-A-53-106125, JP-A-47-3929, JP-A-48-55730, JP-A-46-5187, JP-A-50-73627, and JP-A-57-150841. The difference in sensitivity between these emulsions can be not less than 0.2 log E.

The added amount of the photosensitive silver halide is preferably from 0.03 to 0.6 g/m$^2$, more preferably from 0.05 to 0.4 g/m$^2$, most preferably from 0.1 to 0.4 g/m$^2$ as calculated in terms of coated amount of silver per m$^2$ of photosensitive material. The added amount of the photosensitive silver halide is preferably from 0.01 mol to 0.5 mol, more preferably from 0.02 mol to 0.3 mol per mol of organic silver salt.

Referring to the method and conditions for mixing the photosensitive silver halide and the organic silver salt which have been separately prepared, a method involving the mixing of the silver halide grains and the organic silver salt thus prepared using a high speed agitator, ball mill, sand mill, colloid mill, oscillating mill, homogenizer or the like or a method which comprises adding the photosensitive silver halide which has been prepared to the organic silver salt at any time during the preparation thereof to prepare a desired organic silver salt may be used. However, the method for mixing the two components is not specifically limited so far as the effect of the invention can be thoroughly exerted. Further, it is a practice desirable for the adjustment of photographic properties to mix two or more aqueous dispersions of organic silver salt and two or more aqueous dispersions of photographic silver salts.

The time at which the silver halide of the invention is added to the image-forming layer coating solution is between 180 minutes before coating and shortly before coating, preferably between 60 minutes before coating and 10 seconds before coating. However, the mixing method and conditions are not specifically limited so far as the effect of the invention can be thoroughly exerted. Specific examples of the mixing method include a method which comprises mixing in a tank in such a manner that the average residence time calculated from the flow rate and the rate of feed to the coater reaches a desired value and a method involving the use of a static mixer disclosed in N. Harnby, M. F. Edwards, A. W. Nienow, "Ekitai Kongo Gijutsu (Technique for mixing liquids)", translated by Koji Takahashi, Nikkan Kogyo Shinbun, 1989, Chapter 8.

The binder to be incorporated in the organic silver salt-containing layer of the invention may be any polymer. The binder which can be preferably used is transparent or semi-transparent and normally colorless. Examples of such a binder include natural resins, polymers and copolymers, synthetic resins, polymers and copolymers, and other film-forming media. Specific examples of these materials include gelatins, rubbers, polyvinyl alcohols, hydroxyethyl celluloses, cellulose acetates, cellulose acetate butyrates, polyvinyl pyrrolidones, casein, starch, polyacrylic acids, polymethyl methacrylic acids, polyvinyl chlorides, polymethacrylic acids, styrene-maleic anhydride copolymers, styrene-acrylonitrile copolymers, styrene-butadiene copolymers, polyvinyl acetals (e.g., polyvinyl formal, polyvinyl butyral), polyesters, polyurethanes, phenoxy resins, polyvinylidiene chlorides, polyepoxides, polycarbonates, polyvinyl acetates, polyolefins, cellulose esters, and polyamides. The binder may be formed into a coating film from water, an organic solvent or emulsion.

In the invention, improvement is provided when the organic silver salt-containing layer is formed by a process which comprises applying a coating solution having water in an amount of not smaller than 30% by weight based on the total amount of solvent, and then drying the coated amount, or when the binder in the organic silver salt-containing layer is soluble or dispersible in a solvent mainly comprising an aqueous solvent (aqueous solvent), particularly when the binder is made of a polymer latex having an equilibrium water content of not greater than 2% by weight at a temperature of 25° C. and a relative humidity of 60%. The most preferred embodiment of the binder is a polymer latex prepared such that the ionic conductivity reaches not greater than 2.5 mS/cm. An example of this preparation method is to purify the polymer thus synthesized through a separating membrane.

The term "a solvent mainly comprising an aqueous solvent" capable of dissolving or dispersing the polymer therein as used herein is meant to indicate water or a mixture of water and a water-miscible organic solvent in an amount of not greater than 70% by weight based on the weight of the mixture. Examples of such a water-miscible organic solvent include alcohols such as methyl alcohol, ethyl alcohol and propyl alcohol, cellosolves such as methyl cellosolve, ethyl cellosolve and butyl cellosolve, ethyl acetate, and dimethyl formamide.

Also in the case of a system the polymer is not thermodynamically dissolved, i.e., exists in a so-called dispersed state, the term "a solvent mainly comprising an aqueous solvent" is used.

The term "equilibrium water content at a temperature of 25° C. and a relative humidity of 60%" as used herein can be represented by the following equation using the weight W1 of the polymer in conditioning equilibrium in an atmosphere of temperature of 25° C. and a relative humidity of 60% and the bone dry weight W0 of the polymer:

$$\text{Equilibrium water content at 25° C. and 60% RH} = [(W1 - W0)/W0] \times 100 \text{ (wt \%)}$$

For the definition and measurement of water content, reference can be made to "Kobunshi Kogaku Koza 14 (Institute of Polymer Engineering 14): Kobunshi Zairyo Shikenho (Method for testing polymer materials)", The Society of Polymer Science, Japan, Chijin Shokan.

The equilibrium water content of the binder polymer to be used in the invention at a temperature of 25° C. and a relative humidity of 60% is preferably not greater than 2% by weight, more preferably from 0.01 to 1.5% by weight, more preferably from 0.02 to 1% by weight.

In the invention, a polymer dispersible in a solvent mainly comprising an aqueous solvent is particularly preferred. Examples of the dispersed state of polymer include a latex having a water-insoluble hydrophobic polymer particle dispersed therein and a polymer dispersed in an arrangement such that a molecular state or micelle is formed. Any of these dispersed states is desirable. The average diameter of dispersed grains is preferably from about 1 to 50,000 nm, more preferably from about 5 to 1,000 nm. The distribution of grain diameter of dispersed grains is not specifically limited but may be broad or monodisperse.

Preferred examples of the polymer dispersible in a solvent mainly comprising an aqueous solvent in the invention include hydrophobic polymers such as acrylic polymer, polyester, rubber (e.g., SBR resin), polyurethane, polyvinyl chloride, polyvinyl acetate, polyvinylidene chloride and polyolefin. These polymers may be in the form of straight-chain polymer, branched polymer, crosslinked polymer, so-called homopolymer obtained by polymerization of single monomers or copolymer obtained by polymerization of two or more monomers. The copolymer may be a random copolymer or block copolymer. The molecular weight of these polymers is from 5,000 to 1,000,000, preferably from 10,000 to 200,000 as calculated in terms of number-average molecular weight. When the molecular weight of the polymer is too low, the resulting emulsion layer has an insufficient dynamic strength. On the contrary, the polymer having too high a molecular weight exhibits poor film-forming properties to disadvantage.

Specific preferred examples of the polymer latex will be given below. The following examples are represented by monomers used as starting material. The figure in parentheses indicates % by weight. The molecular weight indicates number-average molecular weight.

P-1: Latex of -MMA(70)-EA(27)-MAA(3)- (molecular weight: 37,000)

P-2: Latex of -MMA(70)-2EHA(20)-St(5)-AA(5)- (molecular weight: 40,000)

P-3: Latex of -St(50)-Bu(47)-MAA(3)- (molecular weight: 45,000)

P-4: Latex of -St(68)-Bu(29)-AA(3)- (molecular weight: 60,000)

P-5: Latex of -St(71)-Bu(26)-AA(3)- (molecular weight: 60,000)

P-6: Latex of -St(70)-Bu(27)-IA(3)- (molecular weight: 120,000)

P-7: Latex of -St(75)-Bu(24)-AA(1)- (molecular weight: 108,000)

P-8: Latex of -St(60)-Bu(35)-DVB(3)-MAA(2)- (molecular weight: 150,000)

P-9: Latex of -St(70)-Bu(25)-DVB(2)-AA(2)- (molecular weight: 280,000)

P-10: Latex of -VC(50)-MMA (20)-EA(20)-AN(5)-AA(5)- (molecular weight: 80,000)

P-11: Latex of -VDC(85)-MMA(5)-EA(20)-MAA(5)- (molecular weight: 67,000)

P-12: Latex of -Et(90)-MMA(10)- (molecular weight: 12,000)

P-13: Latex of -St(70)-2EHA(27)-AA(3) (molecular weight: 130,000)

P-14: Latex of -MMA(63)-EA(35)-AA(2) (molecular weight: 33,000)

The foregoing abbreviations indicate the following monomers. MMA: methyl methacrylate; EA: ethyl acrylate; MAA: methacrylic acid; 2EHA: 2-ethylhexyl acrylate; St: styrene; Bu: butadiene; AA: acrylic acid; DVB: divinylbenzene; VC: vinyl chloride; AN: acrylonitrile; VDC: vinylidene chloride; Et: ethylene; IA: itaconic acid As the foregoing polymer latexes there may be used the following commercially available polymers. Examples of acrylic polymers include Cevian A-4635, 46583, 4601 (produced by DAICEL CHEMICAL INDUSTRIES, LTD.), and Nipol Lx811, 814, 821, 820, 857 (produced by Nippon Zeon Co., Ltd.). Examples of polyesters include FINETEX ES650, 611, 675, 850 (produced by DAINIPPON INK & CHEMICALS, INC.), WD-size, and WMS (produced by Eastman Chemical Inc.). Examples of polyurethanes include HYDRAN AP10, 20, 30, 40 (produced by DAINIPPON INK & CHEMICALS, INC.). Examples. of rubbers include LACSTAR 7310K, 3307B, 4700H, 7132C (produced by DAINIPPON INK & CHEMICALS, INC.), and Nipol Lx416, 410, 438C, 2507 (produced by Nippon Zeon Co., Ltd.). Examples of polyvinyl chlorides include G351, G576 (produced by Nippon Zeon Co., Ltd.). Examples of polyvinylidene chlorides include L502, L513 (produced by ASAHI KASEI CORPORATION). Examples of polyolefins include Chemipearl S120, SA100 (produced by Mitsui Petrochemical Industries, Ltd.).

These polymer latexes may be used singly. If necessary, two or more of these polymer latexes may be blended.

As the polymer latex to be used in the invention there may be preferably used a latex of styrene-butadiene copolymer in particular. The ratio of styrene monomer unit to butadiene monomer unit in the styrene-butadiene copolymer by weight is from 40:60 to 95:5. The proportion of styrene monomer unit and butadiene monomer unit in the copolymer is preferably from 60 to 99% by weight. The preferred range of the molecular weight of the polymer latex is as defined above.

Examples of the latex of styrene-butadiene copolymer which can be preferably used in the invention include the foregoing P-3 to P-8, and LACSTAR-3307B, 7132C, and Nipol Lx416, which are commercially available.

The latex to be used in the invention preferably has a glass transition temperature (Tg) of from 10° C. to 80° C., more preferably from 20° C. to 60° C. In the case where two or more latexes having different Tg values are blended, it is preferred that the weight-average Tg thereof fall within the above defined range.

The organic silver salt-containing layer of the photothermographic image-recording material of the invention may comprise a hydrophilic polymer such as gelatin, polyvinyl alcohol, methyl cellulose, hydroxypropyl cellulose and carboxymethyl cellulose incorporated therein as necessary. The amount of such a hydrophilic polymer to be incorporated is preferably not greater than 30% by weight, more preferably not greater than 20% by weight based on the total amount of the binder incorporated in the organic silver salt-containing layer.

The organic silver salt-containing layer (i.e., image-forming layer) of the photothermographic image-recording material of the invention is preferably formed with using a polymer latex together. Referring to the amount of the binder in the organic silver salt-containing layer, the ratio of all binders to organic silver salt by weight is preferably from 1/10 to 10/1, more preferably from 1/5 to 4/1.

The organic silver salt-containing layer is normally a photosensitive layer (emulsion layer) containing a photosensitive silver halide as a photosensitive silver salt. In this structure, the ratio of all binders to silver halide by weight is preferably from 5 to 400, more preferably from 10 to 200.

The total amount of binders to be incorporated in the image-forming layer is preferably from 0.2 to 30 g/m$^2$, more preferably from 1 to 15 g/m$^2$. The image-forming layer may comprise a crosslinking agent for crosslinking, a surface active agent for improving coatability, etc. incorporated therein.

The solvent for the organic silver salt-containing layer coating solution to be used in the invention (for simplicity, solvent and dispersant are collectively referred to as "solvent") is preferably a solvent mainly comprising an aqueous solvent containing water in an amount of not smaller than 30% by weight. As components other than water there may be used any water-miscible organic solvents such as methyl alcohol, ethyl alcohol, isopropyl alcohol, methyl cellosolve, ethyl cellosolve, dimethyl formamide and ethyl acetate. The water content in the solvent for coating solution is preferably not smaller than 50% by weight, more preferably not smaller than 70% by weight. Preferred examples of solvent composition include water, 90/10 mixture (by weight) of water and methyl alcohol, 70/30 mixture of water and methyl alcohol, 80/15/5 mixture of water, methyl alcohol and dimethylformamide, 85/10/5 mixture of water, methyl alcohol and ethyl cellosolve, and 85/10/5 mixture of water, methyl alcohol and isopropyl alcohol.

Examples of fog inhibitor, stabilizer and stabilizer precursor which can be used in the invention include those disclosed in JP-A-10-62899 (paragraph (0070]), and EP-A-0803764 (line 57, page 20—line 7, page 21). The fog inhibitor which can be preferably used in the invention is an organic halogen compound. Examples of such an organic halogen compound include those disclosed in JP-A-11-65021 (paragraphs [0111]-[0112]). In particular, organic halogen compounds represented by the formula (P) in JP-A-2000-284399 and organic polyhalogen compounds represented by the formula (II) in JP-A-10-339934 are preferred.

The organic polyhalogen compound which can be preferably used in the invention will be further described hereinafter. The polyhalogen compound which can be preferably used in the invention is a compound represented by the following formula (III):

$$Q-(Y)n-C(Z^1)(Z^2)X \quad \text{(III)}$$

wherein Q represents an alkyl, aryl or heterocyclic group which may be substituted; Y represents a divalent connecting group; n represents 0 or 1; $Z^1$ and $Z^2$ each represents a halogen atom; and X represents a hydrogen atom or electrophilic group.

In the formula (III), Q preferably represents a phenyl group substituted by an electrophilic group whose up value according to Hammett's rule is a positive value. Specific examples of such an electrophilic group include cyano group, alkoxycarbonyl group, aryloxycarbonyl group, carbamoyl group, sulfamoyl group, alkylsulfonyl group, arylsulfonyl group, sulfoxido group, acryl group, heterocyclic group, halogen atom, halogenated alkyl group, and phosphoryl group. The value of up is preferably from 0.2 to 2.0, more preferably from 0.4 to 1.0. Particularly preferred examples of the electrophilic group include carbamoyl group, alkoxycarbonyl group, alkylsulfonyl group, and alkylphosphoryl group. Most preferred among these electrophilic groups is carbamoyl group.

Specific examples of the compound of the formula (III) to be used in the invention will be given below.

(P-1)

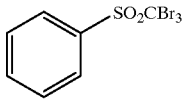

-continued (P-2)

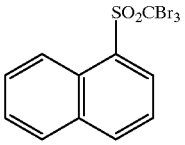

(P-3)

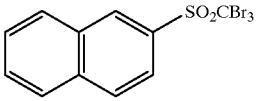

(P-4)

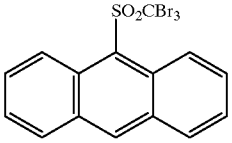

(P-5)

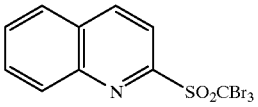

(P-6)

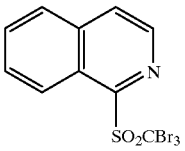

(P-7)

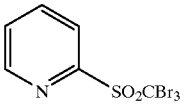

(P-8)

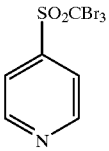

(P-9)

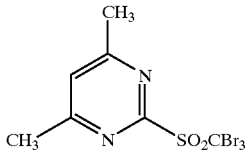

(P-10)

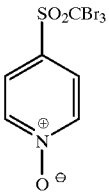

(P-11)

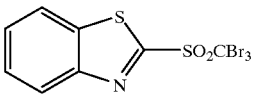

-continued
(P-12)
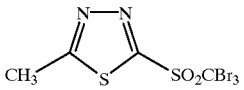
(P-13)
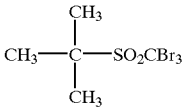
(P-14)
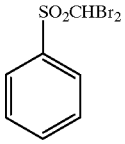
(P-15)
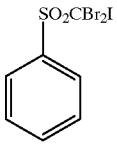
(P-16)
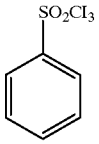
(P-17)
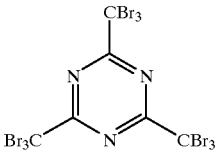
(P-18)
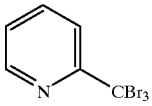
(P-19)
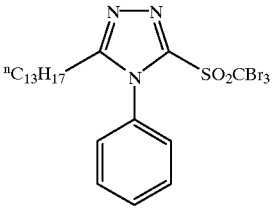
(P-20)
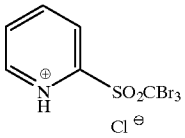
-continued
(P-21)
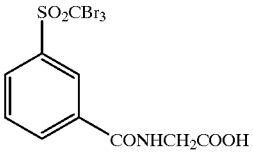
(P-22)
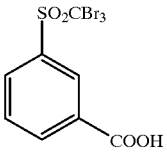
(P-23)
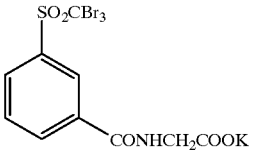
(P-24)
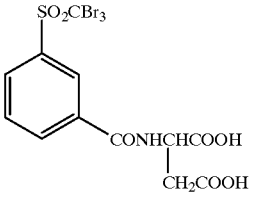
(P-25)
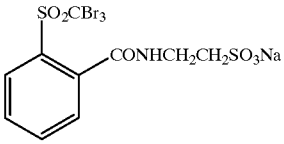
(P-26)
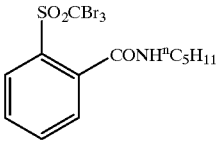
(P-27)
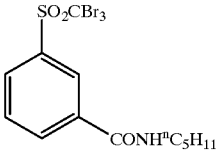
(P-28)
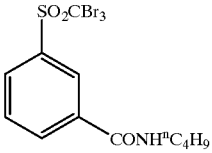

-continued
(P-29)
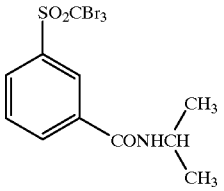
(P-30)
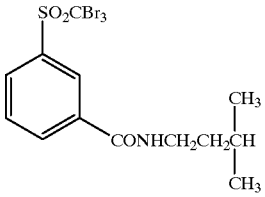
(P-31)
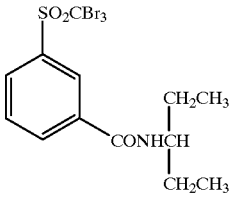
(P-32)
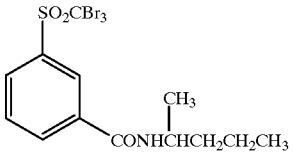
(P-33)
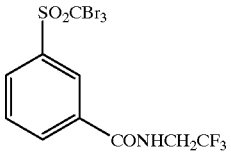
(P-34)
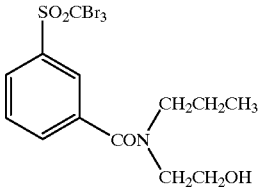
(P-35)
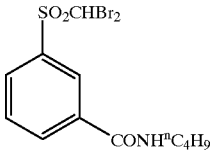
(P-36)
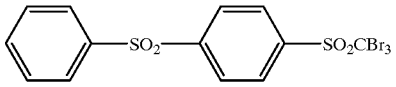
-continued
(P-37)
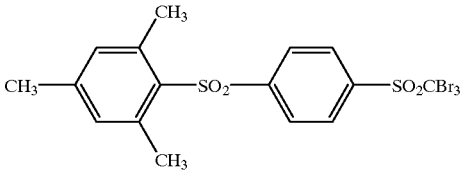
(P-38)
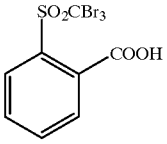
(P-39)
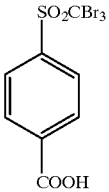
(P-40)
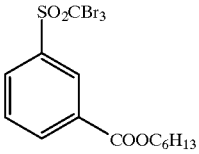
(P-41)
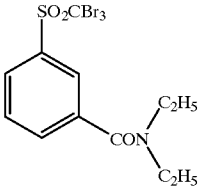
(P-42)
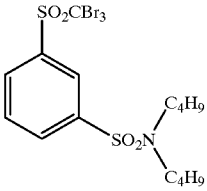
(P-43)
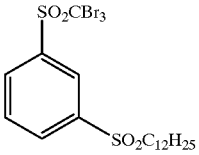
(P-44)
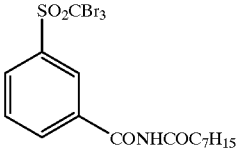

-continued (P-45)

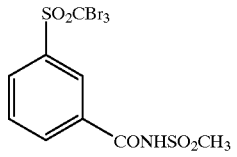

An example of the method for incorporating the fog inhibitor in the image-recording material of the present invention is the method described with reference to the reducing agent. The organic polyhalogen compound is preferably incorporated in the form of dispersion of fine solid particles.

Other examples of the fog inhibitor employable (paragraph [0113]), benzoic acids disclosed in JP-A-11-65021 (paragraph [0114]), salicylic acid derivatives represented by the formula (Z) disclosed in JP-A-2000-284399, formalin scavenger compounds represented by the formula (S) disclosed in JP-A-2000-221634, triazine compounds according to claim 9 of JP-A-11-352624, compounds represented by the formula (III) disclosed in JP-A-6-11791, and 4-hydroxy-6-methyl-1,3,3*a*,7-tetrazaindene.

The photothermographic image-recording material of the invention may comprise an azolium salt incorporated therein for the purpose of inhibiting fogging. Examples of the azolium salt employable herein include compounds represented by the formula (XI) disclosed in JP-A-59-193447, compounds disclosed in JP-B-55-12581, and compounds represented by the formula (II) disclosed in JP-A-60-153039. The azolium salt may be added to the photosensitive material at any site. The layer at which the azolium salt is added to the photosensitive material is a layer on the photosensitive layer side thereof, preferably the organic silver salt-containing layer. The time at which the azolium salt is added may be any time during the preparation of coating solution. In the case where the azolium salt is incorporated in the organic silver salt-containing layer, the time at which the azolium salt is added may be any time between the preparation of the organic silver salt and the preparation of the coating solution, preferably between after the preparation of the organic silver salt and shortly before coating. The azolium salt may be added in any form such as powder, solution and fine dispersion. The azolium salt may be added in the form of solution of mixture with other additives such as sensitizing dye, reducing agent and color toner. The amount of the azolium salt to be added in the invention may be arbitrary but is preferably from $1\times10^{-6}$ mol to 2 mols, more preferably from $1\times10^{-3}$ mol to 0.5 mol per mol of silver.

The photothermographic image-recording material of the invention may comprise a mercapto compound, a disulfide compound or a thione compound incorporated therein to inhibit, accelerate or control development, enhance the spectral sensitization efficiency or improving the storage properties before and after development. Examples of these compounds include compounds disclosed in JP-A-10-62899 (paragraphs [0067]-[0069]), and compounds represented by the formula (I) disclosed in JP-A-10-186572. Specific examples of these compounds include those disclosed in JP-A-10-186572, EP-A-0803764 (lines 36-56, page 20), and JP-A-2001-100358. Preferred among these compounds are mercapto-substituted heterocyclic aromatic compounds.

The photothermographic image-recording material of the invention preferably comprises a color toner incorporated therein. For the details of color toner, reference can be made to JP-A-10-62899 (paragraphs [0054]-[0055]), EP-A-0803764 (lines 23-48, page 21), and JP-A-2000-35631. In particular, phthalazinones (phthalazinone, phthalazinone derivative or metal salt thereof, e.g., 4-(1-naphthyl) phthalazinone, 6-chlorophthalazinone, 5,7-dimethoxyphthalazinone, 2,3-dihydro-1,4-phthalazinone), combination of phthalazinones and phthalic acids (e.g., phthalic acid, 4-methylphthalic acid, 4-nitrophthalic acid, tetrachlorophthalic anhydride), phthalazines (phthalazine, phthalazine derivative or metal salt thereof, e.g., 4-(1-naphthyl)phthalazine, 6-isopropylphthalazine, 6-t-butyl phthalazine, 6-chlorophthalazine, 5,7-dimethoxy phthalazine, 2,3-dihydrophthalazine), and combination of phthalazines and phthalic acids are preferred. Particularly preferred among these color toners is combination of phthalazines and phthalic acids.

For the details of plasticizer and lubricant to be incorporated in the photosensitive layer of the photothermographic image-recording material of the invention, reference can be made to JP-A-11-65021 (paragraph [0117]). For the details of super contrasting agent for forming ultrahigh contrast image and method and amount of addition thereof, reference can be made to JP-A-11-65021 (paragraph [0118]), JP-A-11-223898 (paragraphs [0136]-[0193]), compounds represented by the formulae (H), (1) to (3), (A) and (B) disclosed in JP-A-2000-284399, and compounds represented by the formulae (III) to (V) (Compounds [ka-21] to [ka-24]) disclosed in Japanese Patent Application No. 11-91652. For the details of contrasting accelerator, reference can be made to JP-A-11-65021 (paragraph [0102]), and JP-A-11-223898 (paragraphs [0194]-[0195]).

In order to use formic acid or formate as a strong fogging agent, it is preferred that formic acid or formate be incorporated in the photothermographic image-recording material on the side thereof where the image-forming layer containing a photosensitive silver halide is provided in an amount of not greater than 5 mmol, more preferably not greater than 1 mmol per mol of silver.

In the a super contrasting agent is incorporated in the photothermographic image-recording material of the invention, an acid obtained by the hydration of diphosphorus pentaoxide or salt thereof is preferably used as well. Examples of the acid obtained by the hydration of diphosphorus pentaoxide or salt thereof include metaphosphoric acid (metaphosphate) pyrophosphoric acid (pyrophosphate), orthophosphoric acid (orthophosphate), triphosphoric acid (triphosphate), tetraphosphoric acid (tetraphosphate), and hexametaphosphoric acid (hexametaphosphate). Preferred among these acids obtained by the hydration of diphosphorus pentaoxide or salt thereof are orthophosphoric acid (orthophosphate), and hexametaphosphoric acid (hexametaphosphate). Specific examples of these salts include sodium orthophosphate, sodium dihydrogen orthophospate, sodium hexametaphosphate, and ammonium hexametaphosphate.

The amount of the acid obtained by the hydration of diphosphorus pentaoxide or salt thereof to be used (coated amount per $m^2$ of image-recording material) may be arbitrary depending on the properties such as sensitivity and fog but is preferably from 0.1 to 500 $mg/m^2$, more preferably from 0.5 to 100 $mg/m^2$.

The photothermographic image-recording material of the invention may comprise a surface protective layer provided thereon for the purpose of preventing the adhesion of the image-forming layer. The surface protective layer may consist of a single layer or a plurality of layers. For the details of the surface protective layer, reference can be made to JP-A-11-65021 (paragraphs [0119]-[01201]).

As the binder for the surface protective layer there is preferably used gelatin. Another preferred example of the binder is a polyvinyl alcohol (PVA). Examples of gelatin employable herein include inert gelatin (e.g., Nitta Gelatin 750), and phthalated gelatin (e.g., Nitta Gelatin 801). Examples of PVA employable herein include PVA-105 (fully-saponified), PVA-205 (partly-saponified), PVA-335, and MP-203 (modified polyvinyl alcohol)(All these products are available from KURARAY CO., LTD.). The coated amount of polyvinyl alcohol (per $m^2$ of support) in the protective layer (per one layer) is preferably from 0.3 to 4.0 $g/m^2$, more preferably from 0.3 to 2.0 $g/m^2$.

In the case where the photothermographic image-recording material of the invention is used for printing purpose subject to dimensional change, it is preferred that a polymer latex be incorporated in the surface protective layer or back layer. For the details of such a polymer latex, reference can be made to Taira Okuda and Hiroshi Inagaki, "Gousei Jushi Emarujon (Synthetic resin emulsion)", Kobunshi Kankokai, 1978, Takaaki Sugimura, Yasuo Kataoka, Soichi Suzuki, Keiji Kasahara, "Gousei Ratekkusu no Ouyou (Application of Synthetic Latex)", Kobunshi Kankokai, 1993, Soichi Muroi, "Gousei Ratekkusu no Kagaku (Chemistry of Synthetic Latex)", Kobunshi Kankokai, 1970, etc. Specific examples of these polymer latexes include latex of methyl methacrylate (33.5% by weight)/ethyl acrylate (50% by weight)/methacrylic acid (16.5% by weight) copolymer, latex of methyl methacrylate (47.5% by weight)/butadiene (47.5% by weight)/itaconic acid (5% by weight) copolymer, latex of ethyl acrylate/methacrylic acid copolymer, latex of methyl methacrylate (58.9 by weight)/2-ethylhexyl acrylate (25.4% by weight)/styrene (8.6% by weight)/2-hydroxyethyl methacrylate (5.1% by weight)/acrylic acid (2.0% by weight) copolymer, and latex of methyl methacrylate (64.0% by weight)/styrene (9.0% by weight)/butyl acrylate (20.0% by weight)/2-hydroxyethyl methacylate (5.0% by weight)/acrylic acid (2.0% by weight) copolymer. For the binder for the surface protective layer, there may be applied a combination of polymer latexes disclosed in Japanese Patent Application No. 11-6872, a technique disclosed in JP-A-2000-267226 (paragraphs [0021]-[0025]), a technique disclosed in Japanese Patent Application No. 11-6872 (paragraphs [0027]-[0028]), and a technique disclosed in JP-A-2000-19678 (paragraphs [0023]-[0041]). The proportion of the polymer latex in the surface protective layer is preferably from 10 to 90% by weight, particularly from 20 to 80% by weight based on the total weight of the binder.

The coated amount (per $m^2$ of support) of the total binder (containing the water-soluble polymer and latex polymer) in the surface protective layer (per one layer) is preferably from 0.3 to 5.0 $g/m^2$, more preferably from 0.3 to 2.0 $g/m^2$.

The preparation temperature of the image-forming layer coating solution is preferably from 30° C. to 65° C., more preferably from not lower than 35° C. to lower than 60° C., even more preferably from 35° C. to 55° C. The temperature of the image-forming layer coating solution to which the polymer latex has just been added is preferably kept at a range of from 30° C. to 65° C. The image-forming layer coating solution preferably comprises a reducing agent and an organic silver salt incorporated therein before the addition of the polymer latex.

The image-forming layer of the invention consists of one or more layers provided on a support. The image-forming layer, if composed of a single layer, is formed by an organic silver salt, a photosensitive silver halide, a reducing agent, a binder, and optionally desired additional materials such as color toner, coating aid and other auxiliary agents. The image-forming layer, if composed of two or more layers, must comprises an organic silver salt and a photosensitive silver halide incorporated in a first image-forming layer (normally a layer adjacent to the support) and some other components incorporated in a second image-forming layer or both the first and second image-forming layers. A multi-color photosensitive heat-developable image-recording material may comprise such a combination of two layer for each of the colors or may comprise all the components incorporated in a single layer as disclosed in U.S. Pat. No. 4,708,928. In a multi-dye multi-color photosensitive heat-developable image-recording material, a functional or non-functional barrier layer is normally provided interposed between the various photosensitive layers to keep the photosensitive layers distinguished from each other.

The photosensitive layer may comprise various dyes or pigments (e.g., C. I. Pigment Blue 60, C. I. Pigment Blue 64, C. I. Pigment Blue 15:6) incorporated therein from the standpoint of improvement of color tone, prevention of the generation of interference fringe during exposure to laser beam and prevention of irradiation. For the details of these dyes and pigments, reference can be made to WO98/36322, JP-A-10-268465, and JP-A-11-338098. In the photothermographic image-recording material of the invention, an antihalation layer may be provided more remote from the light source than the photosensitive layer.

The photothermographic image-recording material normally comprises photoinsensitive layers in addition to the photosensitive layer. These photoinsensitive layers are classified as (1) protective layer provided on the photosensitive layer (on the side further than the support), (2) interlayer provided between a plurality of photosensitive layers or between the photosensitive layer and the protective layer, (3) subbing layer provided between the photosensitive layer and the support, and (4) back layer provided on the other side of the photosensitive layer according to their positions. A filter layer is provided as the layer (1) or (2) in the photosensitive material. The antihalation layer is provided as the layer (3) or (4) in the photosensitive material.

For the details of antihalation layer, reference can be made to JP-A-11-65021 (paragraphs [0123]-[0124]), JP-A-11-223898, JP-A-9-230531, JP-A-10-36695, JP-A-10-104779, JP-A-11-231457, JP-A-11-352625, and JP-A-11-352626.

The antihalation layer comprises an antihalation dye having absorption in the wavelength range to which the photosensitive material is exposed. When the wavelength range to which the photosensitive material is exposed falls within the infrared range, an infrared-absorbing dye may be used. Such an infrared-absorbing dye preferably has no absorption in the visible light range.

In the case where a dye having absorption in the visible light range is used to prevent halation, it is preferably arranged such that the color of the dye does not substantially remain after the formation of image. A means for extinguishing the color of the dye by heat applied during heat development is preferably used. In particular, it is preferred that a heat-extinguishable dye and a base precursor be incorporated in a photoinsensitive layer to provide an antihalation layer. For the details of these techniques, reference can be made to JP-A-11-231457.

The amount of the heat-extinguishable dye to be incorporated is determined depending on the purpose. In general, the heat-extinguishable dye is used in an amount such that the optical density (absorbance) measured at the desired wavelength exceeds 0.1. The optical density of the dye is preferably from 0.2 to 2. The amount of the dye to be used to obtain optical density in this range is normally from about 0.001 to 1 g/m$^2$.

By thus extinguishing the color of the dye, the optical density after heat development can be lowered to not greater than 0.1. Two or more extinguishable dyes may be used in combination in the heat-extinguishable recording material or photothermographic image-recording material. Similarly, two or more base precursors may be used in combination.

For the heat-extinguishing using a extinguishable dye and a base precursor, a material which lowers its melting point by 3° C. or more when mixed with a base precursor (e.g., diphenylsulfone, 4-chlorophenyl(phenyl)sulfone) as disclosed in JP-A-11-352626 is preferably used as well from the standpoint of heat-extinguishability.

The photothermographic image-recording material of the invention may comprise a colorant having maximal absorption in the range of from 300 nm to 450 nm incorporated therein for the purpose of improving silver tone and eliminating image deterioration with time. For the details of such a colorant, reference can be made to JP-A-62-210458, JP-A-63-104046, JP-A-63-103235, JP-A-63-208846, JP-A-63-306436, JP-A-63-314535, JP-A-01-61745, and JP-A-2001-100363.

Such a dye is normally incorporated in an amount of from 0.1 mg/m$^2$ to 1 g/m$^2$, preferably in the back layer provided on the other side of the photosensitive layer.

The photothermographic image-recording material of the invention is preferably a so-called one-sided photosensitive material having at least one photosensitive layer containing a silver halide emulsion on at least one side of the support and a back layer on the other.

The photothermographic image-recording material of the invention preferably comprises a matting agent incorporated therein to improve its conveyability. For the details of the matting agent, reference can be made to JP-A-11-65021 (paragraphs [0126]-[0127]). The amount of the matting agent to be used is preferably from 1 to 400 mg/m$^2$, more preferably from 5 to 300 mg/m$^2$ as calculated in terms of coated amount per m$^2$ of image-recording material.

The matted degree of the emulsion surface may be arbitrary so far as no "star defects" occur. In practice, however, the Bekk second is preferably from 30 seconds to 2,000 seconds, particularly from 40 seconds to 1,500 seconds. The Bekk second can be easily determined by "Method for testing the smoothness of paper and paperboard by Bekk tester" defined in JIS P8119 or TAPPI standard method T479.

In the invention, the matted degree of the back layer is preferably from 10 seconds to 1,200 seconds, more preferably from 20 seconds to 800 seconds, even more preferably from 40 seconds to 500 seconds as calculated in terms of Bekk second.

In the invention, the matting agent is preferably incorporated in the outermost layer or a layer which acts as an outermost layer in the image-recording material, or a layer close to the outer surface of the image-recording material, or a layer which acts as a so-called protective layer.

For the details of the back layer which can be applied to the invention, reference can be made to JP-A-11-65021 (paragraphs [0128]-[0130]).

The photothermographic image-recording material of the invention preferably exhibits a pH value of not greater than 6.0, more preferably not greater than 5.5 on the surface thereof before heat development. The lower limit of the pH value is not specifically limited. In practice, however, it is about 3. For the adjustment of pH value of the surface of the photothermographic image-recording material, an organic acid such as phthalic acid derivative, a nonvolatile acid such as sulfuric acid or a volatile base such as ammonia is preferably used because the pH value of the surface of the photothermographic image-recording material is lowered. In particular, ammonia is preferably used to accomplish low pH value on the surface of the photothermographic image-recording material because it can easily evaporate and thus can be removed before coating step or heat development. For the details of method for measuring the pH value on the surface of the photothermographic image-recording material, reference can be made to JP-A-2000-284399 (paragraph [0123]).

The various layers such as photosensitive layer, protective layer and back layer of the invention may comprise a hardener incorporated therein. For the details of such a hardener, reference can be made to T. H. James, "THE THEORY OF THE PHOTOGRAPHIC PROCESS FOURTH EDITION", Macmillan Publishing Co., Inc., 1977, pp. 77 - 87. Specific examples of the hardener include chromium alum, 2,4-dichloro-6-hydroxy-s-triazine sodium salt, N,N-ethylenebis (vinylsulfonacetamide), N,N-propylenebis (vinyl-sulfonacetamide), polyvalent metal ions disclosed on page 78 in the above cited reference, polyisocyanates disclosed in U.S. Pat. No. 4,281,060 and JP-A-6-208193, epoxy compounds disclosed in U.S. Pat. No. 4,791,042, and vinylsulfone-based compounds disclosed in JP-A-62-89048.

The hardener is added in the form of solution. The time at which the solution of hardener is added is between 180 minutes before coating and shortly before coating, preferably from 60 minutes before coating and 10 seconds before coating. The mixing method and conditions are not specifically limited so far as the effect of the invention can be fully exerted. Specific examples of the mixing method include a method which comprises mixing in a tank in such a manner that the average residence time calculated from the flow rate and the rate of feed to the coater reaches a desired value and a method involving the use of a static mixer disclosed in N. Harnby, M. F. Edwards, A. W. Nienow, "Ekitai Kongo Gijutsu (Technique for mixing liquids)", translated by Koji Takahashi, Nikkan Kogyo Shinbun, 1989, Chapter 8.

For the details of the surface active agent which can be used in the invention, reference can be made to JP-A-11-65021 (paragraph [0132]). For the details of the solvent which can be used in the invention, reference can be made to JP-A-11-65021 (paragraph [0133]). For the details of the support which can be used in the invention, reference can be made to JP-A-11-65021 (paragraph [0134]). For the details of the antistatic or electrically-conductive layer which can be used in the invention, reference can be made to JP-A-11-65021 (paragraph [0135]). For the details of the method for obtaining a color image which can be used in the invention, reference can be made to JP-A-11-65021 (paragraph [0136]). For the details of the lubricant which can be used in the invention, reference can be made to JP-A-11-84573 (paragraphs [0061]-[0064]) and Japanese Patent Application No. 11-106881 (paragraphs [0049]-[0062]).

The photothermographic image-recording material of the invention is preferably of monosheet type (type which can form an image on the photothermographic image-recording material without using other sheets such as image-receiving material).

The photothermographic image-recording material of the invention may further comprise an oxidation inhibitor, a stabilizer, a plasticizer, an ultraviolet absorber or a coating aid incorporated therein. The various additives are incorporated in either the photosensitive layer or the photoinsensitive layer. For the details of these techniques, reference can be made to WO98/36322, EP-A-803764, JP-A-10-186567, JP-A-10-18568, etc.

The photothermographic image-recording material of the invention may be formed by any coating method. In some detail, various coating methods such as extrusion coating, slide coating, curtain coating, dip coating, knife coating, flow coating and extrusion coating using a hopper of the type disclosed in U.S. Pat. No. 2,681,294 may be used. Preferred examples of the coating method employable herein include extrusion coating disclosed in Stephen F. Kistler, Peter M. Schweizer, "LIQUID FILM COATING", CHAPMAN & HALLM 1997, pp. 399-536, and slide coating. Particularly preferred among these coating methods is slide coating. An example of the shape of the slide coater to be used in slide coating is shown in Figure 11*b*.1 of Stephen F. Kistler, Peter M. Schweizer, "LIQUID FILM COATING", CHAPMAN & HALLM 1997, page 427. If necessary, the method disclosed in Stephen F. Kistler, Peter M. Schweizer, "LIQUID FILM COATING", CHAPMAN & HALLM 1997, pp. 399-536, U.S. Pat. No. 2,761,791, and British Patent 837,095 can be used to apply two or more layers at the same time.

The organic silver salt-containing layer coating solution of the invention is preferably a so-called thixotropic fluid. The term "thixotropic property" as used herein is meant to indicate a nature that as the shear rate increases, the viscosity decreases. For the measurement of viscosity, any measuring instrument may be used. In practice, however, a Type RFS fluid spectrometer produced by Rheometric Scientific F. E. Ltd. is preferably used. The measurement of viscosity is conducted at a temperature of 25° C. The organic silver salt-containing layer coating solution for use in the present invention preferably exhibits a viscosity of from 400 mPa.s to 100,000 mPa.s, more preferably from 500 mPa.s to 20,000 mPa.s at a shear rate of 0.1 $S^{-1}$ or from 1 mPa.s to 200 mPa.s, more preferably from 5 mPa.s to 80 mPa.s at a shear rate of 1,000 $S^{-1}$.

Various systems showing thixotropic property have been known as described in "Kouza Rheology (Rheology Institute)", Koubunshi Kankokai, Muroi and Morino, "Koubunshi Ratekkusu (Polymer latex)", Koubunshi Kankokai, etc. A fluid needs to contain a large amount of fine solid grains to exhibit thixotropic property. In order to intensify thixotropic property, it is effective to incorporate a thickened linear polymer in the fluid, increase the anisotropy of fine solid grains contained therein to raise the aspect ratio thereof, thicken the fluid with an alkali or use a surface active agent.

Examples of techniques which can be used for the photothermographic image-recording material of the invention include those disclosed in EP-A-803764, EP-A-883022, WO98/36322, JP-A-56-62648, JP-A-56-62644, JP-A-9-281637, JP-A-9-297367, JP-A-9-304869, JP-A-9-311405, JP-A-9-329865, JP-A-10-10669, JP-A-10-62899, JP-A-10-69023, JP-A-10-186568, JP-A-10-90823, JP-A-10-171063, JP-A-10-186565, JP-A-10-186567, JP-A-10-186569, JP-A-10-186570, JP-A-10-186571, JP-A-10-186572, JP-A-10-197974, JP-A-10-197982, JP-A-10-197983, JP-A-10-197985, JP-A-10-197986, JP-A-10-197987, JP-A-10-207001, JP-A-10-207004, JP-A-10-221807, JP-A-10-282601, JP-A-10-288823, JP-A-10-288824, JP-A-10-307365, JP-A-10-312038, JP-A-10-339934, JP-A-11-7100, JP-A-11-15105, JP-A-11-24200, JP-A-24201, JP-A-11-30832, JP-A-11-84574, JP-A-11-65021, JP-A-11-109547, JP-A-11-125880, JP-A-11-129629, JP-A-11-133536, JP-A-11-133537, JP-A-11-133538, JP-A-11-133539, JP-A-11-133542, JP-A-11-133543, JP-A-11-223898, and JP-A-11-352627.

The photothermographic image-recording material of the invention may be subjected to development in any manner. In practice, however, the photothermographic image-recording material which has been imagewise exposed to light is developed at a raised temperature. The development temperature is preferably from 80° C. to 250° C., more preferably from 100° C. to 140° C. The development time is preferably from 1 to 180 seconds, more preferably from 10 to 90 seconds, particularly from 10 to 40 seconds.

As the heat development process there is preferably used a plate heater process. As the heat development process using a plate heater there is preferably used one disclosed in JP-A-11-133572. This plate heater process employs a heat development device which is adapted to bring a photothermographic image-recording material having a latent image formed therein into contact with a heating means in a heat development zone to obtain a visible image. The heating means comprises a plate heater. A plurality of hold-down rollers are provided opposed to the plate heater along one side of the plate heater. In this arrangement, the photothermographic image-recording material is passed through the gap between the hold-down roller and the plate heater. The plate heater is preferably composed of 2 to 5 stages. The temperature of the forward end is preferably about 1° C. to 10° C. lower than that of the rest of the heating area. This process is described also in JP-A-54-30032. In this arrangement, the water content and organic solvent contained in the photothermographic image-recording material can be removed therefrom. Further, the photothermographic image-recording material can be prevented from being rapidly heated, making it possible to prevent the change of the shape of the support of the photothermographic image-recording material.

The photosensitive material of the invention may be exposed to light in any manner. In practice, however, laser beam is preferably used as an exposing light source. Preferred examples of the laser beam employable herein include gas laser ($Ar^+$, He—Ne) beam, YAG laser beam, dye laser beam, and semiconductor laser beam. Further, semiconductor laser beam and second harmony wave generating element may be used. Preferred among these lasers are gas or semiconductor lasers which emit light in the range of from red to infrared.

As a medical laser imager provided with an exposing zone and a heat development zone there may be used a Type FM-DP L dry laser imager produced by Fuji Medical Co., Ltd. For the details of FM-DP L, reference can be made to Fuji Medical Review No. 8, pp. 39-55. It goes without saying that these techniques are used as laser imager for the photothermographic image-recording material of the invention. These techniques can be also used as photothermographic image-recording material for laser imager in "AD network" proposed by Fuji Medical System as a network system conforming to DICOM standard.

The photothermographic image-recording material of the invention is adapted to form a black-and-white silver image and thus is preferably used as a photothermographic image-recording material for medical diagnosis, industrial photography, printing or COM.

The present invention will be further described in the following examples, but the present invention should not be construed as being limited thereto.

EXAMPLES 1 TO 5 AND COMPARATIVE EXAMPLES A, B AND 1 TO 3

Preparation of PET Support

Terephthalic acid and ethylene glycol were processed in an ordinary manner to obtain PET having an intrinsic viscosity IV of 0.66 (measured at 25° C. in a 6/4 (by weight) mixture of phenol and tetrachloroethane). PET thus obtained was pelletized, dried at a temperature of 130° C. for 4 hours, melted at a temperature of 300° C., extruded through a T-die, and then cooled rapidly to prepare an unoriented film having a thermally-fixed thickness of 175 μm.

The unoriented film was then longitudinally stretched by a factor of 3.3 using rolls having different circumferential speeds at a temperature of 110° C. The film was then crosswise stretched by a factor of 4.5 using a tenter at a temperature of 130° C. Thereafter, the film was thermally fixed at a temperature of 240° C. for 20 seconds. The film was then crosswise relaxed by a factor of 4% at the same temperature. Thereafter, the portion of the film caught by the chuck of the tenter was removed by slitting. The both ends of the film was then knurled. The film was then wound at a tension of 4 kg/cm$^2$ to obtain a roll of a film having a thickness of 175 μm.

Surface Corona Discharge Treatment

Using a Type 6KVA solid state corona discharge treatment device produced by NIPPON PILLAR PACKING CO., LTD., the support was treated on the both sides thereof at room temperature at a rate of 20 m/min. From the reading of current and voltage, it was found that the support had been treated at 0.375 kV.A.min/m$^2$. The frequency at which the treatment is effected was 9.6 kHz. The clearance between the electrode and the dielectric roll was 1.6 mm.

Preparation of Undercoated Support (1 ) Preparation of subbing layer coating solution

Preparation of Subbing Layer Coating Solution A

To an aqueous dispersion of polyester (for the kind of the dispersion and its added amount, see Table 1) were added 0.9 g of PMMA fine particle (MP-1000, produced by SOKEN CHEMICAL & ENGINEERING CO., LTD.; average particle diameter: 0.4 μm) and 4 g of a 10 wt % solution of polyethylene glycol monophenyl ether (average number of ethylene oxides: 8.5). To the mixture was then added distilled water to make 1,000 ml. Thus, the subbing layer coating solution A was obtained.

Abbreviation:

TPA: terephthalic acid

IPA: isophthalic acid

IPS: sodium sulfoisophthalate

EG: ethylene glycol

DEG: diethylene glycol

CHDM: cyclohexanedimethanol

NPG: neopentyl glycol

Comparative Examples

1. Pesresin A-515GB (modified aqueous polyester produced by TAKAMATSU OIL & FAT CO.,LTD)

Tg: 60° C.; solid content concentration: 30%; added amount: 240 g

2. Finetex ES-675 (aqueous polyester produced by DAINIPPON INK & CHEMICALS, INC.)

Tg: 35° C.; solid content concentration: 37%; added amount: 194.6 g

3. Vylon 200 (aqueous polyester produced by TOYOBO CO., LTD.) (TPA/IPA//EG/NPG: 50/50//50/50 (mol %))

Tg: 67° C.

Dissolved in a 4/1 (by weight) mixture of toluene and MEK in such an amount that the solid content concentration reaches 40%

Added amount: 180 g

A. Copolyester No. 13 described in JP-A-56-95959 (to Agfa-Gevaert Japan, Ltd.)

(TPA/IPA/IPS//EG: 50/40/10//100 (mol %))

B. Polyester resin A-2 described in JP-B-62-21380 (to TOYOBO CO., LTD.)

(TPA/IPS//DEG: 93/7//100 (mol %))

Formulation of Back Surface 1st Layer Coating Solution

Butadiene-styrene copolymer latex: 131 g (Solid content: 40 wt %; butadiene/styrene ratio: 32/68 by weight)

8 wt % aqueous of 2,4-dichloro-6-hydroxy-S-triazine sodium salt: 5 g 20 wt % aqueous dispersion of polystyrene particle (average particle diameter: 2 μp): 0.5 g Distilled water: 863.5 ml

TABLE 1

Formulation of water-soluble polyester used (mol %)

| Component | Example 1 | Example 2 | Example 3 | Example 4 | Example 5 | Comparative Example A | Comparative Example B |
|---|---|---|---|---|---|---|---|
| TPA | 90 | | 40 | 70 | | 50 | |
| IPA | | 70 | 40 | | 85 | 40 | 93 |
| IPS | 10 | 30 | 20 | 30 | 15 | 10 | 7 |
| EG | | | | | | 100 | |
| DEG | 70 | 70 | 40 | 50 | 55 | | 100 |
| CHDM | 30 | 30 | 60 | 50 | 45 | | |
| Tg (° C.) | 55 | 79 | 73 | 95 | 53 | 80 | |
| Solid content concentration (%) | 30 | 30 | 30 | 30 | 30 | 20 | 30 |
| Added amount (g) | 240 | 240 | 240 | 240 | 240 | 360 | 240 |

Formulation of Back Surface 1st Layer Coating Solution $SnO_2/Sb_2O_3$ (9/1 (by weight); average grain diameter: 0.04 μp; 17 wt % dispersion): 62 g Gelatin (10% aqueous solution): 66 g Metrose TC-5 (2% aqueous solution), produced by Shin-Etsu Chemical Co., Ltd.: 6 g Proxel (produced by ICI): 0.5 ml Distilled water: 865.5 ml Preparation of Undercoated Support The biaxially-oriented polyethylene terephthalate support having a thickness of 175 μm thus obtained was subjected to the foregoing corona discharge treatment on both sides thereof. The subbing layer coating solution A was applied to one side (photosensitive layer side) of the polyethylene terephthalate support by means of a wire bar in a wet amount of 6.6 ml/$m^2$ (per one side), and then dried at a temperature of 180° C. for 5 minutes. The foregoing back surface 1st subbing layer coating solution was applied to the other side (back surface) of the polyethylene terephthalate support by means of a wire bar in a wet amount of 5.7 ml/$m^2$, and then dried at a temperature of 180° C. for 5 minutes. The foregoing back surface 2nd subbing layer coating solution was applied to the other side (back surface) of the polyethylene terephthalate support by means of a wire bar in a wet amount of 7.7 ml/$m^2$, and then dried at a temperature of 180° C. for 6 minutes to prepare an undercoated support.

Preparation of Back Surface Coating Solution

Preparation of Base Precursor Solid Fine Grain Dispersion (a))

64 g of a base precursor compound 11, 28 g of diphenylsulfone and 10 g of Demol N (surface active agent produced by Kao Corp.) were mixed with 220 ml of distilled water. The mixture was then subjected to dispersion with beads by means of a sand mill (¼ Gallon sand grinder mill produced by Aimex Co., Ltd.) to obtain a dispersion (a) of solid base precursor compound fine grain having an average grain diameter of 0.2 μm.

Preparation of Dispersion of Solid Dye Fine Grains 9.6 g of a cyanine dye compound 13 and 5.8 g of sodium p-dodecylbenzenesulfonate were mixed with 305 ml of distilled water. The mixture was then subjected to dispersion with beads by means of a sand mill (¼ Gallon sand grinder mill produced by Aimex Co., Ltd.) to obtain a dispersion of solid dye fine grains having an average grain diameter of 0.2 μm.

Preparation of Anti-Halation Layer Coating Solution 17 g of gelatin, 9.6 g of a polyacrylamide, 70 g of the foregoing base precursor solid fine grain dispersion (a), 56 g of the foregoing solid dye fine grain dispersion, 1.5 g of a polymethyl methacrylate fine particle (average particle size: 6.5 μm), 0.03 g of benzoisothiazolinone, 2.2 g of sodium polyethylenesulfonate, 0.2 g of a blue dye compound 14, 3.9 g of a yellow dye compound 15, and 844 ml of water were mixed to prepare an anti-halation layer coating solution.

Spectral Sensitizing Dye A

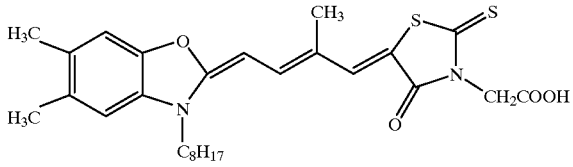

Tellurium Sensitizer B

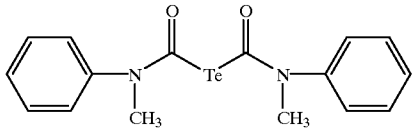

Base Precursor Compound 11

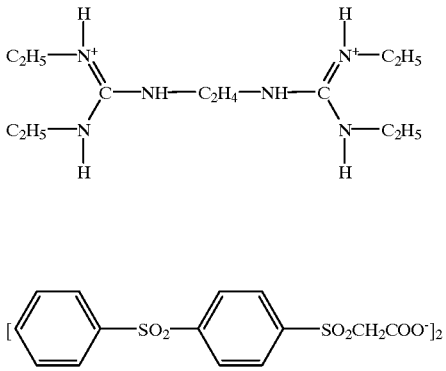

Cyan Dye Compound 13

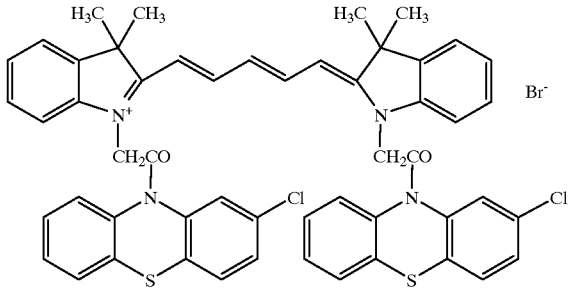

Blue Dye Compound 14

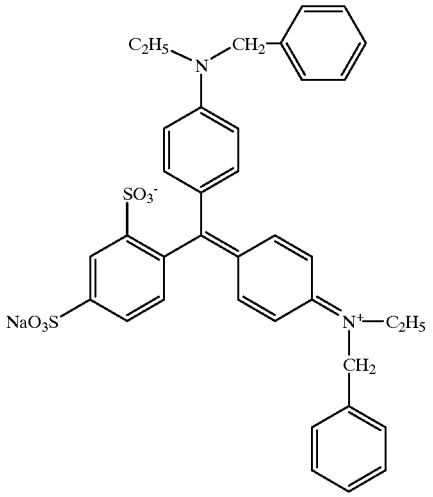

Yellow Dye Compound 15

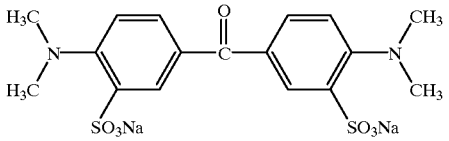

Preparation of Back Surface Protective Layer Coating Solution

In a container which had been kept at a temperature of 40° C., 50 g of gelatin, 0.2 g of sodium polystyrenesulfonate, 2.4 g of N,N-ethylenebis(vinyl-sulfonacetamide), 1 g of sodium t-octylphenoxyethoxy-ethanesulfonate, 30 mg of benzoisothiazoline, 37 mg of potassium salt of N-perfluorooctylsulfonyl-N-propylalanine, 0.15 g of polyethylene glycol mono(N-perfluoro-octylsulfonyl-N-propyl-2-aminoethyl)ether (average ethylene oxide polymerization degree: 15), 32 mg of $C_8F_{17}SO_3K$, 64 mg of $C_8F_{17}SO_2N(C_3H_7)(CH_2CH_2O)_4(CH_2)_4\text{-}SO_3Na$, 8.8 g of an acrylic acid/ethylacrylate copolymer (weight ratio for copolymerization: 5/95), 0.6 g of Aerosol 0T (produced by AMERICAN CYANAMIDE COMPANY), 1.8 g of a liquid paraffin emulsion as a liquid paraffin, and 950 ml of water were mixed to prepare a back surface protective layer coating solution.

Preparation of Silver Halide Emulsion 1

To 1,421 ml of distilled water was added 3.1 ml of a 1 wt % potassium bromide solution. To the mixture were then added 3.5 ml of a 0.5 mol/l sulfuric acid and 31.7 g of phthalated gelatin. To the resulting solution were then added a solution A obtained by diluting 22.22 g of silver nitrate with distilled water to make 95.4 ml and a solution B obtained by diluting 15.9 g of potassium bromide with distilled water to make 97.4 ml at a constant flow rate in 45 seconds with stirring in a stainless steel reaction vessel while being kept at a temperature of 34° C. Thereafter, to the mixture was added 10 ml of a 3.5 wt % aqueous solution of hydrogen peroxide. To the mixture was then added 10.8 ml of a 10 wt % aqueous solution of benzimidazole. To the mixture were then added a solution C obtained by diluting 51.86 g of silver nitrate with distilled water to make 317.5 ml and a solution D obtained by diluting 45.8 g of potassium bromide with distilled water to make 400 ml by a controlled double jet process in such a manner that the solution C was added in 20 minutes at a constant flow rate and the solution D was added while the pAg value thereof was being kept at 8.1. Hexachloroiridate (III) potassium salt was added in 10 minutes after the beginning of the addition of the solutions C and D in such an amount that the concentration reached $1\times10^{-4}$ mol per mol of silver. An aqueous solution of potassium hexacyanoferrate (II) was added in 5 seconds after the termination of the addition of the solution C in such an amount that the concentration reached $3\times10^{-4}$ mol per mol of silver. The emulsion was then adjusted with a 0.5 mol/l sulfuric acid to pH 3.8. The stirring of the emulsion was then suspended. The emulsion was subjected to sedimentation, desalting and rinsing. The emulsion was then adjusted with a 1 mol/l sodium hydroxide to pH 5.9. Thus, a silver halide dispersion having a pAg value of 8.0 was prepared.

To the dispersion was then added 5 ml of a 0.34 wt % methanol solution of 1,2-benzoisothiazoline-3-one with stirring while the temperature thereof was being kept at 38° C. After 40 minutes, to the dispersion was then added a methanol solution of the spectral sensitizing dye A in an amount of $1\times10^{-3}$ mol per mol of silver. After 1 minute, the dispersion was heated to a temperature of 47° C. After 20 minutes from the temperature rise, to the dispersion was then added a methanol solution of sodium benzenethiosulfonate in an amount of $7.6\times10^{-5}$ mol per mol of silver. After 5 minutes, to the dispersion was then added a methanol solution of the foregoing tellurium sensitizer B in an amount of $1.9\times10^{-4}$ mol per mol of silver. The dispersion was then ripened for 91 minutes. To the dispersion was then added 1.3 ml of a 0.8 wt % methanol solution of N,N'-dihydroxy-N"-diethylmelamine. After 4 minutes, to the dispersion were added a methanol solution of 5-methyl-2-mercaptobenzimidazole and a methanol solution of 1-phenyl-2-heptyl-5-mercapto-1,3,4-triazole in an amount of $3.7\times10^{-3}$ mol and $4.9\times10^{-3}$ mol per mol of silver, respectively, to prepare a silver halide emulsion 1.

The silver halide emulsion thus obtained comprised pure silver bromide grains having an average equivalent sphere diameter of 0.046 $\mu$m and an equivalent sphere diameter variation coefficient of 20%. For the measurement of grain size, etc., an electron microscope was used. The value of the size of 1,000 grains were averaged. The proportion of {100} plane in this grain was determined to be 80% as measured by Kubelka-Munk process.

Preparation of Silver Halide Emulsion 2

A silver halide emulsion 2 was prepared in the same manner as in the preparation of the silver halide emulsion 1 except that the temperature at which the grains are formed was changed from 34° C. to 49° C., the solution C was added in 30 minutes, and potassium hexacyanoferrate (II) was not used. The emulsion was then subjected to sedimentation, desalting, rinsing and dispersion in the same manner as the silver halide emulsion 1. The emulsion was then subjected to spectral sensitization and chemical sensitization in the same manner as in the silver halide emulsion 1 except that the added amount of the spectral sensitizing dye A was changed to $7.5\times10^{-4}$ mol per mol of silver and the added amount of the tellurium sensitizer B was changed to $1.1\times10^{-4}$ mol per mol of silver. To the emulsion were then added 5-methyl-2-mercaptobenzimidazole and 1-phenyl-2-heptyl-5-mercapto-1,3,4-triazole. The added amount of 1-phenyl-2-heptyl-5-mercapto-1,3,4-triazole was changed to $3.3\times10^{-3}$ mol per mol of silver. Thus, a silver halide emulsion 2 was obtained. The silver halide emulsion 2 thus obtained comprised pure silver bromide cubic grains having an average equivalent sphere diameter of 0.080 μm and an equivalent sphere diameter variation coefficient of 20%.

Preparation of Silver Halide Emulsion 3

A silver halide emulsion 3 was prepared in the same manner as in the preparation of the silver halide emulsion 1 except that the liquid temperature at which the grains are formed was changed from 34° C. to 27° C. The emulsion was then subjected to sedimentation, desalting, rinsing and dispersion in the same manner as the silver halide emulsion 1. The emulsion was then processed in the same manner as the silver halide emulsion 1 except that the added amount of the spectral sensitizing dye A was changed to $6\times10^{-3}$ mol per mol of silver as calculated in terms of solid dispersion (aqueous solution of gelatin) and the added amount of the tellurium sensitizer B was changed to $5.2\times10^{-4}$ mol per mol of silver. Thus, a silver halide emulsion 3 was obtained. The silver halide emulsion 3 thus obtained comprised pure silver bromide cubic grains having an average equivalent sphere diameter of 0.038 μm and an equivalent sphere diameter variation coefficient of 20%.

Preparation of Mixed Emulsion A for Coating Solution

The silver halide emulsion 1, the silver halide emulsion 2 and the silver halide emulsion 3 were dissolved in an amount of 70 wt %, 15 wt % and 15 wt %, respectively. To the mixture was then added benzothiazolium iodide in the form of 1 wt % aqueous solution in an amount of $7\times10^{-3}$ mol per mol of silver.

Preparation of Aliphatic Acid Silver Dispersion 87.6 kg of behenic acid produced by Henkel Japan Ltd. (trade name: Edenor C22-85R), 423 l of distilled water, 49.2 l of a 5 mol/l aqueous solution of NaOH, and 120 l of tert-butanol were mixed. The mixture was then reacted at a temperature of 75° C. with stirring for 1 hour to obtain a sodium behenate solution. Separately, 206.2 l of an aqueous solution containing 40.4 kg of silver nitrate (pH 4.0) was prepared. The solution was then kept at a temperature of 10° C. To 635 l of distilled water and 30 l of tert-butanol in a reaction vessel were added the foregoing sodium behenate solution and the foregoing aqueous solution of silver nitrate at a constant flow rate with stirring in 62 minutes and 10 seconds and 60 minutes, respectively, while being kept at a temperature of 30° C. During this procedure, only the aqueous solution of silver nitrate was added for 7 minutes and 20 seconds after the beginning of the addition of the aqueous solution of silver nitrate. The addition of the sodium behenate solution then began. Only the sodium behenate solution was added for 9 minutes and 30 seconds after the termination of the addition of the aqueous solution of silver nitrate. The temperature in the reaction vessel was controlled to be 30° C. The ambient temperature was controlled such that the liquid temperature was kept constant. The temperature of the piping in the system for addition of sodium behenate solution was kept at a predetermined value by a steam trace. The steam opening was adjusted such that the temperature of liquid at the outlet of the forward end of the feed nozzle reached 75° C. The temperature of the piping in the system for addition of aqueous solution of silver nitrate was kept at a predetermined value by circulating cold water through the gap between the inner pipe and the outer pipe of a double pipe. The addition position of the sodium behenate solution and the aqueous solution of silver nitrate were symmetrical to each other about the axis of stirring. The addition position of these solutions were adjusted to be on a level such that it does not come in contact with the reaction solution.

After the termination of the addition of the sodium behenate solution, the reaction solution was allowed to stand with stirring at the same temperature for 20 minutes, and then allowed to cool to a temperature of 25° C. Thereafter, the solid content was separated by filtration with suction. The solid content was then washed with water until the filtrate showed a conductivity of 30 μS/Cm. Thus, an aliphatic acid salt was obtained. The solid content thus obtained was then stored undried as a wet cake.

The morphology of the silver behenate grains thus obtained was then evaluated by electron microphotography. As a result, the silver behenate grain was found to be a scaly crystal having a length a of 0.14 μm, a width b of 0.4 μm and a thickness c of 0.6 μm on the average, an average aspect ratio of 5.2, an average equivalent sphere diameter of 0.52 μm and an equivalent sphere diameter variation coefficient of 15% (a, b and c are specified herein).

To the wet cake in an amount corresponding to dried solid content of 100 g were then added 7.4 g of a polyvinyl alcohol (trade name: PVA-217) and water to make 385 g. The mixture was then subjected to pre-dispersion by a homomixer.

The stock solution thus pre-dispersed was then subjected to processing by a dispersing machine (trade name: Type M-110S-EH Microfluidizer, produced by Microfluidex International Corp.; equipped with G10Z interaction chamber) three times with the pressure of the dispersing machine being adjusted to 1,750 kg/cm$^2$ to obtain a silver behenate dispersion. For the cooling operation, a spiral heat exchanger was provided in front and in the rear of the interaction chamber. In this arrangement, the temperature of the coolant was controlled to predetermine the dispersion temperature to 18° C.

Preparation of 25 wt % Dispersion of Reducing Agent

To 10 kg of 1,1-bis(2-hydroxy-3,5-dimethylphenyl)-3,5,5-trimethylhexane and 10 kg of a 20 wt % aqueous solution of a modified polyvinyl alcohol (POVAL MP203, produced by KURARAY CO., LTD.) were added 16 kg of water. The mixture was thoroughly stirred to obtain a slurry. This slurry was fed by a diaphragm pump to a horizontal sand mill (UVM-2, produced by Aimex Co., Ltd.) filled with zirconia beads having an average diameter of 0.5 mm where it was then subjected to dispersion for 3 hours and 30 minutes. To the dispersion were then added 0.2 g of sodium salt of benzoisothiazolinone and water to make a reducing agent concentration of 25 wt %. Thus, a reducing agent dispersion was obtained. The reducing agent dispersion thus obtained comprised reducing agent grains having a median diameter of 0.42 μm and a maximum diameter of not greater than 2.0 μm. The reducing agent dispersion was filtered through a polypropylene filter having a pore diameter of 10.0 μm to remove foreign matters such as dust. The reducing agent dispersion thus obtained was then stored.

Preparation of 25 wt % Dispersion of Reducing Agent Complex

To 10 kg of a 1:1 complex of 2,2-methylenebis-(4-ethyl-6-tert-butylphenol) and triphenyl phosphine oxide and 10 kg of a 20 wt % aqueous solution of a modified polyvinyl alcohol (POVAL MP203, produced by KURARAY CO., LTD.) were added 16 kg of water. The mixture was thoroughly stirred to obtain a slurry. This slurry was fed by a diaphragm pump to a horizontal sand mill (UVM-2, produced by Aimex Co., Ltd.) filled with zirconia beads having an average diameter of 0.5 mm where it was then subjected to dispersion for 3 hours and 30 minutes. To the dispersion were then added 0.2 g of sodium salt of benzoisothiazolinone and water to make a reducing agent concentration of 25 wt %. Thus, a reducing agent complex dispersion was obtained. The reducing agent complex dispersion thus obtained comprised reducing agent complex grains having a median diameter of 0.46 μm and a maximum diameter of not greater than 2.0 μm. The reducing agent complex dispersion was filtered through a polypropylene filter having a pore diameter of 10.0 μm to remove foreign matters such as dust. The reducing agent complex dispersion thus obtained was then stored.

Preparation of 10 wt % Dispersion of Mercapto Compound

To 5 kg of 1-phenyl-2-heptyl-5-mercapto-1,3,4-triazole and 5 kg of a 20 wt % aqueous solution of a modified polyvinyl alcohol (POVAL MP203, produced by KURARAY CO., LTD.) were added 8.3 kg of water. The mixture was thoroughly stirred to obtain a slurry. This slurry was fed by a diaphragm pump to a horizontal sand mill (UVM-2, produced by Aimex Co., Ltd.) filled with zirconia beads having an average diameter of 0.5 mm where it was then subjected to dispersion for 6 hours. To the dispersion was then added water to make a mercapto compound concentration of 10 wt %. Thus, a mercapto dispersion was obtained. The mercapto dispersion thus obtained comprised mercapto grains having a median diameter of 0.40 μm and a maximum diameter of not greater than 2.0 μm. The mercapto compound dispersion was filtered through a polypropylene filter having a pore diameter of 10.0 μm to remove foreign matters such as dust. The mercapto compound dispersion was again filtered through a polypropylene filter having a pore diameter of 10.0 μm shortly before use.

Preparation of 20 wt % Dispersion of Organic Polyhalogen Compound (1)

5 kg of tribromomethyl naphthyl sulfone, 2.5 kg of a 20 wt % aqueous solution of a modified polyvinyl alcohol (POVAL MP203, produced by KURARAY CO., LTD.), 213 g of a 20 wt % aqueous solution of sodium triisopropyl-naphthalenesulfonate and 10 kg of water were thoroughly mixed to obtain a slurry. This slurry was fed by a diaphragm pump to a horizontal sand mill (UVM-2, produced by Aimex Co., Ltd.) filled with zirconia beads having an average diameter of 0.5 mm where it was then subjected to dispersion for 5 hours. To the dispersion were then added 0.2 g of sodium salt of benzoisothiazolinone and water to make an organic polyhalogen compound concentration of 25 wt %. Thus, an organic polyhalogen compound dispersion was obtained. The polyhalogen compound dispersion thus obtained comprised organic polyhalogen compound grains having a median diameter of 0.36 μm and a maximum diameter of not greater than 2.0 μm. The organic polyhalogen compound dispersion thus obtained was filtered through a polypropylene filter having a pore diameter of 3.0 μm to remove foreign matters such as dust. The organic polyhalogen compound dispersion thus obtained was then stored.

Preparation of 25 wt % Dispersion of Organic Polyhalogen Compound (2)

The procedure for the 20 wt % dispersion of organic polyhalogen compound (1) was followed except that 5 kg of tribromomethyl(4-(2,4,6-trimethylphenylsulfonyl)phenyl) sulfone was used instead of 5 kg of tribromomethyl naphthyl sulfone and dispersed, and the dispersion was then diluted to make an organic polyhalogen compound concentration of 25 wt % before filtration. The polyhalogen compound dispersion thus obtained comprised organic polyhalogen compound grains having a median diameter of 0.38 μm and a maximum diameter of not greater than 2.0 μm. The organic polyhalogen compound dispersion thus obtained was filtered through a polypropylene filter having a pore diameter of 3.0 μm to remove foreign matters such as dust. The organic polyhalogen compound dispersion thus obtained was then stored.

Preparation of 26 wt % Dispersion of Organic Polyhalogen Compound (3)

The procedure for the 20 wt % dispersion of organic polyhalogen compound (1) was followed except that 5 kg of tribromomethyl phenyl) sulfone was used instead of 5 kg of tribromomethyl naphthyl sulfone, the amount of the 20 wt % aqueous solution of MP203 was changed to 5 kg, the mixture was then dispersed, and the dispersion was then diluted to make an organic polyhalogen compound concentration of 26 wt % before filtration. The polyhalogen compound dispersion thus obtained comprised organic polyhalogen compound grains having a median diameter of 0.41 μm and a maximum diameter of not greater than 2.0 μm. The organic polyhalogen compound dispersion thus obtained was filtered through a polypropylene filter having a pore diameter of 3.0 μm to remove foreign matters such as dust. The organic polyhalogen compound dispersion thus obtained was then stored at a temperature of not higher than 10° C. before use.

Preparation of 25 wt % Dispersion of Organic Polyhalogen Compound (4)

The procedure for the 20 wt % dispersion of organic polyhalogen compound (1) was followed except that 5 kg of tribromomethyl-3-pentanoylaminophenyl sulfone was used instead of 5 kg of tribromomethyl naphthyl sulfone and dispersed, and the dispersion was then diluted to make an organic polyhalogen compound concentration of 25 wt % before filtration. The polyhalogen compound dispersion thus obtained comprised organic polyhalogen compound grains having a median diameter of 0.41 μm and a maximum diameter of not greater than 2.0 μm. The organic polyhalogen compound dispersion thus obtained was filtered through a polypropylene filter having a pore diameter of 3.0 μm to remove foreign matters such as dust. The organic polyhalogen compound dispersion thus obtained was then stored.

Preparation of 5 wt % Solution of Phthalazine Compound 8 kg of a modified polyvinyl alcohol (POVAL MP203, produced by KURARAY CO., LTD.) was dissolved in 174.57 kg of water. To the aqueous solution were then added 3.15 kg of a 20 wt % aqueous solution of sodium triisopropyl-naphthalenesulfonate and 14.28 kg of a 70 wt % aqueous solution of 6-isopropylphthalazine to prepare a 5 wt % solution of 6-isopropylphthalazine.

Preparation of 20 wt % Dispersion of Pigment

To 64 g of C. I. Pigment Blue 60 and 6.4 g of Demol N (produced by Kao Corp.) was added 250 g of water. The mixture was then thoroughly stirred to make a slurry. 800 g of zirconia beads having an average diameter of 0.5 mm were prepared and then put into a vessel with the slurry. The mixture was then subjected to dispersion by a dispersing machine (¼ Gallon sand grinder mill produced by Aimex Co., Ltd.) to obtain a pigment dispersion. The pigment dispersion thus obtained comprised pigment grains having an average grain diameter of 0.21 μm.

Preparation of 40 wt % SBR Latex

An ultrafiltrated (UP) SER latex was obtained as follows.

Using Module FS03-FC-FUY03A1 for UF purification (produced by DAICEN MEMBRANE SYSTEMS CO., LTD.), a material obtained by diluting the following SBR latex with distilled water by a factor of 10 was subjected to dilution and purification until the ionic conductivity thereof reached 1.5 mS/cm. To the latex was then added Sandet-BL (produced by Sanyo Chemical Industries, Ltd.) to make 0.22 wt %. To the latex were then added NaOH and $NH_4OH$ in such an amount that the ratio of $Na^+$ ion : $NH^{4+}$ ion reached 1:2.3 (by mol) to make pH 8.4. The resulting latex concentration was 40 wt %.

(BBR latex: latex of -St(71)-Bu(26)-AA(3)-)

Average grain diameter: 0.1 μm; concentration: 45 wt %; equilibrium water content at 25° C. and 60% RH: 0.6 wt %; ionic conductivity: 4.2 mS/cm (latex stock solution (40 wt %) was measured at 25° C. by means of a Type CM-30S conductivity meter produced by Toa Electronics Ltd.); and pH 8.2

Preparation of Emulsion Layer (Photosensitive Layer) Coating Solution 1.1 g of the 20 wt % dispersion of pigment thus obtained, 103 g of the aliphatic acid silver dispersion thus obtained, 5 g of the 20 wt % aqueous solution of a polyvinyl alcohol PVA-205 (produced by KURARAY CO., LTD.), 25 g of the 25 wt % dispersion of reducing agent, 16.3 g of a 5:1:3 mixture (by weight) of the organic polyhalogen compound dispersions (1), (2) and (3), 6.2 g of the 10 wt % dispersion of mercapto compound, 106 g of the 40 wt % SBR latex (Tg: 24° C.) which had been subjected to ultrafiltration (UF)/purification and pH adjustment, and 18 ml of the 5 wt % solution of phthalazine compound were mixed. Shortly before being applied, the mixture was thoroughly mixed with 10 g of the mixed silver halide emulsion A to prepare an emulsion layer coating solution which was then fed into a coating die as it was at a rate of 70 ml/$m^2$ for coating.

The viscosity of the foregoing emulsion layer coating solution was 85 (mPa.s) as measured at a temperature of 40° C. by means of a Type B viscometer produced by Tokyo Keiki Kogyo K. K. (No. 1 rotor, 60 rpm).

The coating solution was measured for viscosity at a temperature of 25° C. by means of a Type RFS fluid spectrometer produced by Rheometrics Far East Co., Ltd. As a result, the coating solution exhibited a viscosity of 1,500, 220, 70, 40 and 20 (mPa.s) at a shear rate of 0.1, 1, 10, 100 and 1,000 (1/sec), respectively.

Preparation of Emulsion Surface Interlayer Coating Solution

To 772 g of a 10 wt % aqueous solution of a polyvinyl alcohol PVA-205 (produced by KURARAY CO., LTD.), 5.3 g of a 20 wt % dispersion of pigment and 226 g of a 27.5 wt % solution of a latex of a 64/9/20/5/2 (by weight) copolymer of methyl methacrylate, styrene, butyl acrylate, hydroxyethyl methacrylate and acrylic acid were added 2 ml of a 5 wt % aqueous solution of Aerosol 0T (produced by AMERICAN CYANAMIDE COMPANY), 10.5 ml of a 20 wt % aqueous solution of diammonium phthalate and water to make 880 g. The solution was then adjusted with NaOH to pH 7.5. Thus, an interlayer coating solution was obtained. The coating solution was then fed to a coating die at a rate of 10 ml/$m^2$.

The viscosity of the coating solution was 21 (mPa.s) as measured at a temperature of 40° C. by means of a Type B viscometer (No. 1 rotor, 60 rpm).

Preparation of Emulsion Surface 1st Protective Layer Coating Solution 64 g of an inert gelatin was dissolved in water. To the solution were then added 80 g of a 27.5 wt % solution of a latex of a 64/9/20/5/2 (by weight) copolymer of methyl methacrylate, styrene, butyl acrylate, hydroxyethyl methacrylate and acrylic acid, 23 ml of a 10 wt % methanol solution of phthalic acid, 23 ml of a 10 wt % aqueous solution of 4-methylpthalic acid, 28 ml of a 0.5 mol/l sulfuric acid, 5 ml of a 5 wt % aqueous solution of Aerosol 0T (produced by AMERICAN CYANAMIDE COMPANY), 0.5 g of phenoxyethanol, and 0.1 g of benzoisothiazolinone. To the mixture was then added water to make 750 g to obtain a coating solution. To the coating solution thus obtained was added 26 ml of a 4 wt % chromium alum by means of a static mixer shortly before coating. The coating solution thus prepared was then fed to a coating die at a rate of 18.6 ml/$m^2$.

The viscosity of the coating solution was 17 (mPa.s) as measured at a temperature of 40° C. by means of a Type B viscometer (No. 1 rotor, 60 rpm).

Preparation of Emulsion Surface 2nd Protective Layer Coating Solution 80 g of an inert gelatin was dissolved in water. To the solution were then added 102 g of a 27.5 wt % solution of a latex of a 64/9/20/5/2 (by weight) copolymer of methyl methacrylate, styrene, butyl acrylate, hydroxyethyl methacrylate and acrylic acid, 3.2 ml of a 5 wt % solution of a potassium salt of N-perfluorooctylsulfonyl-N-propylalanine, 32 ml of a 2 wt % aqueous solution of a polyethylene glycol mono(N-perfluorooctylsulfonyl-N-propyl-2-aminoethyl)ether (average ethyleneoxide polymerization degree: 15), 23 ml of a 5 wt % aqueous solution of Aerosol 0T (produced by AMERICAN CYANAMIDE COMPANY), 4 g of a polymethyl methacrylate fine particle (average particle diameter: 0.7 μm), 21 g of a polymethyl methacrylate fine particle (average particle diameter: 6.4 μm), 1.6 g of 4-methyl phthalate, 4.8 g of phthalic acid, 44 ml of a 0.5 mol/l sulfuric acid, and 10 mg of benzoisothiazolinone. To the mixture was then added water to make 650 g. To the mixture was added 445 ml of an aqueous solution containing 4 wt % of chromium alum and 0.67 wt % of phthalic acid by means of a static mixer shortly before coating. The surface protective layer coating solution thus prepared was then fed to a coating die at a rate of 8.3 ml/$m^2$.

The viscosity of the coating solution was 9 (mPa.s) as measured at a temperature of 40° C. by means of a Type B viscometer (No. 1 rotor, 60 rpm).

Preparation of Photothermographic Material (1)

The anti-halation layer coating solution and the back surface protective layer coating solution were simultaneously applied to the foregoing undercoated support on the back surface thereof in an amount such that the coated amount of solid content of solid dye fine grain reached 0.04 $g/m^2$ and the coated amount of gelatin reached 1.7 $g/m^2$ to form two layers which were then dried to form a back layer.

The coating solutions for emulsion layer (coated amount of silver halide: 0.14 $g/m^2$ in terms of silver), interlayer, 1st protective layer and 2nd protective layer were simultaneously applied to the undercoated support on the side thereof opposite the back surface by a slide bead coating process to form these layers in this order. Thus, a photothermographic material sample was prepared. The coating and drying conditions were as follows.

The coating was conducted at a rate of 160 m/min. The clearance between the forward end of the coating die and the support was kept at a range of from 0.10 to 0.30 mm. The pressure in the vacuum chamber was predetermined to be 196 to 882 Pa lower than the atmospheric pressure. The support was destaticized with ionized air before coating.

In the subsequent chilling zone, the coating solution was cooled with air at a dry-bulb temperature of from 10° C. to 20° C. The coated material was conveyed in a non-contact manner, and then dried with dried air at a dry-bulb temperature of 23° C. to 45° C. and a wet-bulb temperature of from 15° C. to 21° C. in a helical non-contact dryer.

After dried, the coated material was moisture-conditioned at a temperature of 25° C. and a relative humidity of from 40% to 60%, and then heated to a temperature of 70° C. to 90° C. on the surface thereof. After heated, the coated material was cooled to a temperature of 25° C. on the surface thereof.

The photothermographic material thus prepared exhibited a matted degree of 550 seconds on the photosensitive layer side thereof and 130 seconds on the back surface thereof as calculated in terms of Bekk second. The photothermographic material was measured for pH on the photosensitive layer side thereof. The results were 6.0.

Evaluation of Adhesion

Using a razor, the sample was cut on the photosensitive layer side thereof at 6 longitudinal and crosswise lines which were apart from each other at an interval of 4 mm, forming 25 checkers thereon. The cut reached the surface of the support. A Mylar tape having a width of 25 mm was stuck to the checkers. The tape was then thoroughly contact-bonded to the sample. After 5 minutes, the Mylar tape was rapidly pulled and peeled off the sample at a peel angle of 180 degrees. This peeling condition was evaluated as adhesion before processing. For the evaluation of adhesion, the number of checkers which had been peeled off the photosensitive layer was counted. The results were then evaluated in accordance with the following criterion:

G: No checkers are peeled

F: Less than 5 checkers are peeled

P: 5 or more checkers are peeled

The sample which had been pressed against a 120° C. heat development drum for 25 seconds to undergo heat development was evaluated for adhesion in the same manner as mentioned above.

This peeling condition was evaluated as adhesion after processing.

Evaluation of Surface Conditions

The sample was visually examined for conditions of coated surface. The surface condition having little uneven coating and no streaks was evaluated as G. The surface condition having some uneven coating and streaks was evaluated as F. The surface condition having a remarkable uneven coating and many streaks was evaluated as P.

Evaluation of Mechanical Stability

Using a Marlon stability testing machine produced by Kumagaya Riki Kogyo K. K., the sample was given a shear force at 25° C., 20 kg and 1,200 rpm for 10 minutes. Thereafter, the resulting coagulated material was filtered through a 400-mesh wire mesh, and then measured for dried weight. The percent coagulation was then determined by the following equation.

$$\%\ \text{Coagulation} = \frac{\text{Weight (g) of dried coagulated content}}{\text{Weight (g) of solid content before test}} \times 100$$

For the evaluation of mechanical stability, when the percent coagulation was not smaller than 0.1%, it was evaluated as P. When the percent coagulation was less than 0.1%, it was evaluated as G. The results of evaluation are set forth in Table 2.

TABLE 2

| Component | Example 1 | Example 2 | Example 3 | Example 4 | Example 5 |
|---|---|---|---|---|---|
| Adhesion (before processing) | G | G | G | G | G |
| Adhesion (after processing) | G | G | G | G | G |
| Surface conditions | G | G | G | G | G |
| Mechanical stability | G | G | G | G | G |

| Component | Comparative Example A | Comparative Example B | Comparative Example 1 | Comparative Example 2 | Comparative Example 3 |
|---|---|---|---|---|---|
| Adhesion (before processing) | P | P | G | F | G |
| Adhesion (after processing) | F | F | G | F | P |
| Surface conditions | G | G | F–P | F | F |
| Mechanical stability | G | G | P | G | G |

EXAMPLE 6

Preparation of Photothermographic Material (2)

A photothermographic material (2) was prepared in the same manner as the photothermographic material (1) except that the emulsion layer coating solution was changed as follows and the same evaluation as for the photothermographic material (1) were carried out. In this case, it was confirmed that the same effects as for the photothermographic material (1) were obtained.

Preparation of Emulsion Layer (Photosensitive Layer) Coating Solution 1.1 g of the 20 wt % dispersion of pigment thus obtained, 103 g of the aliphatic acid silver dispersion thus obtained, 5 g of the 20 wt % aqueous solution of a polyvinyl alcohol PVA-205 (produced by KURARAY CO., LTD.), 26 g of the 25 wt % dispersion of reducing agent complex, 8.2 g of a 1:3 mixture (by weight) of the organic polyhalogen compound dispersions (3) and (4), 6.2 g of the 10 wt % dispersion of mercapto compound, 106 g of the 40 wt % SBR latex (Tg: 24° C.) which had been subjected to ultrafiltration (UF)/purification and pH adjustment, and 18 ml of the 5 wt % solution of phthalazine compound were mixed. Shortly before being applied, the mixture was thoroughly mixed with 10 g of the mixed silver halide emulsion A to prepare an emulsion layer coating solution which was then fed into a coating die as it was at a rate of 70 ml/$m^2$ for coating.

In accordance with the present invention, a photothermographic image-recording material comprising a subbing layer having a good adhesion to the support and emulsion, good surface conditions and a good mechanical stability can be provided.

While the invention has been described in detail and with reference to specific embodiments thereof, it will be apparent to one skilled in the art that various changes and modifications can be made therein without departing from the spirit and scope thereof.

What is claimed is:

1. A photothermographic image-recording material comprising a support, at least one subbing layer comprising a polyester provided on at least one side of the support and an image-forming layer provided on the subbing layer, wherein said polyester is a polyester having a glass transition temperature of from 40° C. to 100° C. comprising an acid component and an alcohol component, said acid component comprises at least one of terephthalic acid and isophthalic acid in a total amount of from 40 to 90 mol % based on the amount of the acid component and isophthalic acid having a sulfonyloxy group represented by the following formula (1) in an amount of from 10 to 60 mol % based on the amount of the acid component, and said alcohol component comprises diethylene glycol in an amount of from 40 to 90 mol % based on the amount of the alcohol component and cyclohexane dimethanol in an amount of from 10 to 60 mol % based on the amount of the alcohol component:

$$-(SO_3)_nM \quad (1)$$

wherein M represents a hydrogen atom, alkaline or alkaline earth metal or quaternary ammonium residue, and n represents the same number as a valence number of M.

2. The photothermographic image-recording material according to claim 1, wherein said image-forming layer comprises a photosensitive silver halide, a photoinsensitive organic silver salt, a reducing agent for silver ion and a binder.

* * * * *